US012232635B2

(12) United States Patent
Filleul et al.

(10) Patent No.: US 12,232,635 B2
(45) Date of Patent: Feb. 25, 2025

(54) BABY BOUNCER WITH ASSISTANCE

(71) Applicant: Chiaro Technology Limited, London (GB)

(72) Inventors: Elise Rebecca Filleul, London (GB); David Connell, London (GB); Simon Peter Cross, London (GB); Benjamin David Garbutt, London (GB)

(73) Assignee: Chiaro Technology Limited, London (GB)

( * ) Notice: Subject to any disclaimer, the term of this patent is extended or adjusted under 35 U.S.C. 154(b) by 0 days.

(21) Appl. No.: 18/437,983

(22) Filed: Feb. 9, 2024

(65) Prior Publication Data

US 2024/0268573 A1 Aug. 15, 2024

(30) Foreign Application Priority Data

Feb. 9, 2023 (GB) ..... 2301858

(51) Int. Cl.
*A47D 13/10* (2006.01)

(52) U.S. Cl.
CPC ..... *A47D 13/107* (2013.01)

(58) Field of Classification Search
CPC ..... A47D 13/107; A47D 13/10
USPC ..... 297/DIG. 11, 177
See application file for complete search history.

(56) References Cited

U.S. PATENT DOCUMENTS 2,587,121 A * 2/1952 Deardorff ..... B60N 2/40 267/132
3,054,591 A 9/1962 Cohn
3,331,632 A 7/1967 Robert
3,359,035 A 12/1967 Bernard
4,139,131 A 2/1979 Hathaway
4,141,095 A * 2/1979 Adachi ..... A47D 9/057 297/451.7
4,181,356 A 1/1980 Fleischer
4,205,406 A 6/1980 Wangkeo et al.
4,344,649 A 8/1982 Fleischer
5,342,113 A * 8/1994 Wu ..... A47D 13/107 297/260.2
6,257,070 B1 7/2001 Giallorenzo et al.
6,869,368 B1 3/2005 Clarke et al.
7,347,089 B1 3/2008 Kelley et al.
8,316,490 B1 11/2012 Bilak et al.
(Continued)

FOREIGN PATENT DOCUMENTS

CA 3173448 A1 9/2021
CN 204368233 U 6/2015
(Continued)

OTHER PUBLICATIONS

Combined Search and Examination Report in GB2211541.4, dated Feb. 3, 2023, 5 pages.
(Continued)

*Primary Examiner* — Milton Nelson, Jr.
(74) *Attorney, Agent, or Firm* — Sterne, Kessler, Goldstein & Fox P.L.L.C.

(57) ABSTRACT

A baby bouncer with assistance having a base, a seat to receive a baby, a joint connecting the seat with the base and configured to support the seat above the base, and an actuator connected between the base and the seat. The joint permits reciprocating motion of the seat relative to the base. The actuator can impart a driving force on the seat.

24 Claims, 15 Drawing Sheets

(56) References Cited

U.S. PATENT DOCUMENTS

| | | | | |
|---|---|---|---|---|
| 8,708,832 | B2 | 4/2014 | Gilbert et al. | |
| 8,784,227 | B2 * | 7/2014 | Speedie | A47D 13/105 472/135 |
| 9,629,476 | B1 | 4/2017 | Robbins et al. | |
| 10,106,187 | B1 | 10/2018 | Farrar et al. | |
| 2002/0002741 | A1 | 1/2002 | Tomas et al. | |
| 2002/0113469 | A1 | 8/2002 | Stern et al. | |
| 2003/0069079 | A1 | 4/2003 | Kelly et al. | |
| 2007/0205646 | A1 | 9/2007 | Bapst et al. | |
| 2007/0262627 | A1 | 11/2007 | Clapper et al. | |
| 2008/0255503 | A1 | 10/2008 | Quackenbush et al. | |
| 2008/0271243 | A1 | 11/2008 | Burkholder et al. | |
| 2009/0062622 | A1 | 3/2009 | Lin | |
| 2009/0284050 | A1 | 11/2009 | Myers | |
| 2009/0284058 | A1 | 11/2009 | Gillett | |
| 2010/0062917 | A1 | 3/2010 | Nanna et al. | |
| 2012/0181830 | A1 | 7/2012 | Gooris | |
| 2013/0026805 | A1 | 1/2013 | Sclare et al. | |
| 2013/0214567 | A1 | 8/2013 | Miller | |
| 2014/0068859 | A1 | 3/2014 | Alegria | |
| 2015/0082539 | A1 | 3/2015 | Lin et al. | |
| 2015/0289678 | A1 | 10/2015 | Vinje Brustad et al. | |
| 2015/0342368 | A1 | 12/2015 | Corso et al. | |
| 2016/0174728 | A1 | 6/2016 | Karp et al. | |
| 2016/0183695 | A1 | 6/2016 | Veron | |
| 2016/0304004 | A1 | 10/2016 | Sandbothe et al. | |
| 2016/0345751 | A1 | 12/2016 | Mountz et al. | |
| 2017/0340285 | A1 | 11/2017 | Rubin et al. | |
| 2018/0325280 | A1 | 11/2018 | Paperno et al. | |
| 2019/0059611 | A1 * | 2/2019 | Burns | A47D 9/057 |
| 2019/0247611 | A1 | 8/2019 | Karp et al. | |
| 2019/0335916 | A1 | 11/2019 | Taylor et al. | |
| 2019/0374044 | A1 | 12/2019 | Acevedo et al. | |
| 2021/0077673 | A1 | 3/2021 | Mason et al. | |
| 2023/0117090 | A1 | 4/2023 | Mountz et al. | |
| 2023/0263316 | A1 * | 8/2023 | Herrin | A47D 13/107 297/260.1 |
| 2023/0338630 | A1 | 10/2023 | Claassen et al. | |
| 2023/0404290 | A1 * | 12/2023 | Nottage | A47D 13/105 |

FOREIGN PATENT DOCUMENTS

| | | | | |
|---|---|---|---|---|
| CN | 113080655 | A | | 7/2021 |
| CN | 216135540 | U | * | 3/2022 |
| DE | 102014200790 | A1 | | 8/2014 |
| EP | 3549843 | A1 | | 10/2019 |
| EP | 4000661 | A1 | | 5/2022 |
| GB | 2163045 | A | | 2/1986 |
| GB | 2511915 | A | | 9/2014 |
| WO | WO-2015118652 | A1 | | 8/2015 |

OTHER PUBLICATIONS

Combined Search and Examination Report in GB2211542.2, mailed on Jan. 25, 2023, 7 pages.

International Search Report and Written Opinion for Application No. PCT/EP2023/071935, mailed on Oct. 26, 2023, 8 pages.

International Search Report and Written Opinion for Application No. PCT/EP2023/071966, mailed on Oct. 26, 2023, 9 pages.

International Search Report and Written Opinion for Application No. PCT/EP2024/053348, mailed on Jul. 15, 2024, 15 pages.

* cited by examiner

BABY BOUNCER WITH ASSISTANCE

BACKGROUND

A baby bouncer or infant soothing device (for example a swing, a rocker, or other oscillating seat) may include a seat or a portion to receive a baby and a means to allow the baby to be gently rocked, swayed, bounced, or otherwise oscillated in a soothing motion. Bouncers typically include a flexible frame and can be activated manually by an adult such that they will oscillate up and down for a short amount of time. Once the oscillation has decayed, the adult must reactivate the bouncer to maintain the oscillation. Swings may allow a different, side to side, motion of the baby in a seat. Typically, a swing will be suspended from above at a bearing and may be manually activated by an adult under the force of gravity to swing back and forth for a short time before the swinging motions decay. Drive systems in swings can be used to directly control the motion by driving the seat continuously along a path. However, the systems which achieve this motion along the path are typically complex and do not accurately replicate the natural motions that an adult may impart on an unassisted swing. Parents may also feel some degree of disconnection from their baby when using such devices because they detach the adult from interacting with the baby. What is needed is an improved infant soothing device which overcomes these and other limitations.

SUMMARY

There is provided an infant soothing device, including a baby bouncer as defined in the appended claims. There is also provided methods of operating infant soothing devices according to the appended claims.

In a first embodiment there is provided a baby bouncer comprising a base; a seat configured to receive a baby; a joint connecting the seat with the base and configured to support the seat above the base, and wherein the joint is configured to permit reciprocating motion of the seat relative to the base; an actuator connected between the base and the seat, and configured to impart a driving force on the seat.

The actuator may be an electromagnetic actuator and wherein the driving force is a magnetic force.

The joint may comprise a resilient member configured to support the seat at a central position above the base and return the seat towards the central position after the seat has been deflected.

The joint may comprise a hinge or an axle configured to support the seat at a central position above the base and allow rotation of the seat relative to the base.

The baby bouncer may further comprise a resilient member connected to the seat and to the base and configured to return the seat towards the central position after the seat has been deflected, and optionally wherein the baby bouncer comprises an adjustment member connected to the resilient member and configured to adjust a pre-load applied to the resilient member.

The resilient member may comprise an extension spring, optionally wherein the extension spring is a coil spring.

The joint may be located at a first height and first lateral position relative to the base, the extension spring being connected to the seat at a first connection point, the extension spring being connected to the base at a second connection point, and the second connection point being located at a second height and a second lateral position relative to the base, and wherein the first connection point lies substantially on a straight line between the joint and the second connection point.

The baby bouncer may be configured such that deflection of the seat causes an extension and a rotation of the resilient member.

Rotation of the resilient member may be such that it changes the effective spring rate of the restoring force to return the seat towards the central position.

The seat may comprise a swingarm and a baby receptacle, wherein the swingarm extends substantially from the baby receptacle and past the hinge or axle.

The hinge or axle may be supported by a post extending upwardly from the base.

The electromagnetic actuator may comprise an electromagnetic coil fixed to the base the seat comprising a magnetic material in proximity to the electromagnetic coil. Optionally the magnetic material is a ferromagnetic material or a permanent magnet.

The electromagnetic actuator may comprise an electromagnetic coil fixed to the seat and the base comprises a magnetic material in proximity to the electromagnetic coil. Optionally the magnetic material is a ferromagnetic material or a permanent magnet.

The baby bouncer may further comprise an electrical driver configured to drive the electromagnetic coil with an electric current. Optionally, the electrical driver is configured to provide an electric current to attract the magnetic material. Optionally, the electrical driver is configured to provide an electric current to repel the magnetic material.

The baby bouncer may further comprise a sensor configured to detect one or more of the deflection of the seat relative to the base, the velocity of the seat relative to the base, and the acceleration of the seat. Optionally, the sensor comprises an optical encoder, electromagnetic encoder, a Micro Electromechanical Sensor (MEMS) device, a gyroscope, an accelerometer, or the electromagnetic coil.

The sensor may be connected to a processor, wherein the processor is configured to derive the velocity of the seat relative to the base from multiple measurements of the deflection of the seat relative to the base, or wherein the processor is configured to derive the velocity of the seat relative to the base by numerical integration of the acceleration of the seat.

Optionally, when the sensor or processor detects a velocity of the seat in a first direction relative to the base the electromagnetic actuator is configured to drive the seat in the first direction.

Optionally, when the sensor or processor detects a velocity of the seat in a second direction opposite to the first direction, the electromagnetic actuator is configured to not drive the seat in the first direction or the second direction.

The sensor or processor may be configured to detect a maximum displacement of the seat relative to the base without the electromagnetic actuator driving the seat.

The sensor may be configured to detect current displacement of the seat relative to the base whilst the electromagnetic actuator is driving the seat.

When the current displacement of the seat relative to the base is less than the maximum displacement of the seat relative to the base, the electromagnetic actuator may be configured to provide a greater drive force to deflect the seat, and when the current displacement of the seat relative to the base is greater than the maximum displacement of the seat relative to the base, the electromagnetic actuator may be configured to provide a lesser drive force to deflect the seat.

The sensor or processor may be configured to detect a maximum displacement of the seat relative to the base without the electromagnetic actuator driving the seat in response to a trigger, and optionally wherein the trigger is caused by a button on the baby bouncer, or by a connected device, or by deflection of the seat relative to the base exceeding a predetermined threshold.

Optionally, the maximum displacement of the seat relative to the base is retrieved from electronic memory or from a server in communication with the baby bouncer.

The maximum displacement of the seat relative to the base may be user adjustable.

Optionally, the sensor or processor is configured to detect when the velocity of the seat relative to the base drops below a predetermined threshold for more than a predetermined time period, and, in response to detecting when the velocity of the seat drops below the predetermined threshold for more than the predetermined time period, the electromagnetic actuator is configured to cease driving the seat relative to the base, and optionally wherein in response to detecting when the velocity of the seat drops below the predetermined threshold for more than the predetermined time period the electromagnetic actuator is configured to apply a braking force to the seat relative to the base.

The electromagnetic actuator may comprise a load cell configured to detect the force applied by the electromagnetic actuator. Optionally, the electromagnetic actuator is configured to cease driving the seat relative to the base when the force detected by the load cell exceeds a predefined threshold.

The actuator may be releasably connected between the base and the seat, and optionally wherein the actuator is configured to be disconnected from the base and disconnected from the seat.

Optionally, the joint is configured such that the reciprocating motion of the seat extends in a substantially vertical direction with respect to the base. Further optionally, the joint is configured such that the reciprocating motion of the seat follows a path, and wherein the path is linear or circular, or elliptical, or follows a figure of 8.

There is also provided a method of controlling a baby bouncer, comprising providing a seat resiliently mounted to a base such that the seat may oscillate about a midpoint; measuring a first deflection of the oscillation of the seat in a first direction; measuring a second deflection of the oscillation of the seat in the first direction; determining that the measured first deflection is different from the measured second deflection; and providing an energy input to correct the deflection of the oscillation of the seat in the first direction.

The baby bouncer may further comprise an actuator connected between the base and the seat and the step of providing an energy input to correct the deflection of the oscillation of the seat in the first direction comprises controlling the actuator to impart a force on the seat in the first direction.

Optionally, the first deflection of the oscillation of the seat in the first direction is a user-controlled manual deflection of the seat.

Further optionally, the second deflection of the oscillation of the seat in the first direction is an actuator-controlled deflection of the seat.

The actuator may be an electromagnetic actuator.

Measuring of the first deflection of the oscillation of the seat in the first direction may be initiated by a button in communication with the baby bouncer, a user device in communication with the baby bouncer, or automatically upon detection of manual movement of the seat in the first direction beyond a predetermined threshold.

Measuring of the first deflection of the oscillation of the seat in the first direction may be performed in a first bouncing session, and the measuring of the second deflection of the oscillation of the seat in the first direction is performed in a second bouncing session, and optionally wherein the first bouncing session and the second bouncing session are separated by a time period of no oscillation of the seat.

There is also provided a method of controlling a baby bouncer comprising: providing a seat resiliently mounted to a base such that the seat may oscillate about a midpoint; detecting, using a sensor, a deflection of the seat in a first direction; detecting, using the sensor, a deflection of the seat in a second direction opposite to the first direction; imparting a driving force to the seat in the first direction when the deflection of the seat in the first direction is detected; and not imparting a driving force to the seat when the deflection of the seat in the second direction is detected.

The driving force may be imparted to the seat by means of an actuator, optionally an electromagnetic actuator.

The seat may be mounted to the base by a bearing and the resilience is provided by a spring. Optionally, the spring is configured to have a spring rate such that the maximum force provided by the electromagnetic actuator is exceeded by the maximum force provided by the spring at a maximum deflection of the seat. The sensor may comprise one or more of an optical encoder, an inductive sensor, an accelerometer, or a position sensor.

In a further embodiment, there is provided an infant soothing device comprising a stand, an infant receiving portion; wherein the infant receiving portion is rotatably mounted on the stand; and a biasing means connected to the infant receiving portion and configured to cause a rotation of the infant receiving portion relative to the stand.

The biasing means may be an active biasing means, and optionally the active biasing means is configured to convert an electrical input into rotation of the infant receiving portion. The active biasing means may comprise one or more of an electrical coil, a coil spring, a leaf spring, a pneumatic chamber, and a hydraulic chamber.

The infant receiving portion may be rotatably mounted on the stand such that the infant receiving portion extends vertically away from the stand, or such that the infant receiving portion extends horizontally away from the stand, and optionally wherein the infant receiving portion is configured to oscillate about a midpoint. The oscillation about a midpoint of the infant receiving portion may be configured to extend in a substantially vertical direction, or in a substantially horizontal direction.

DETAILED DESCRIPTION

Figure 1A:
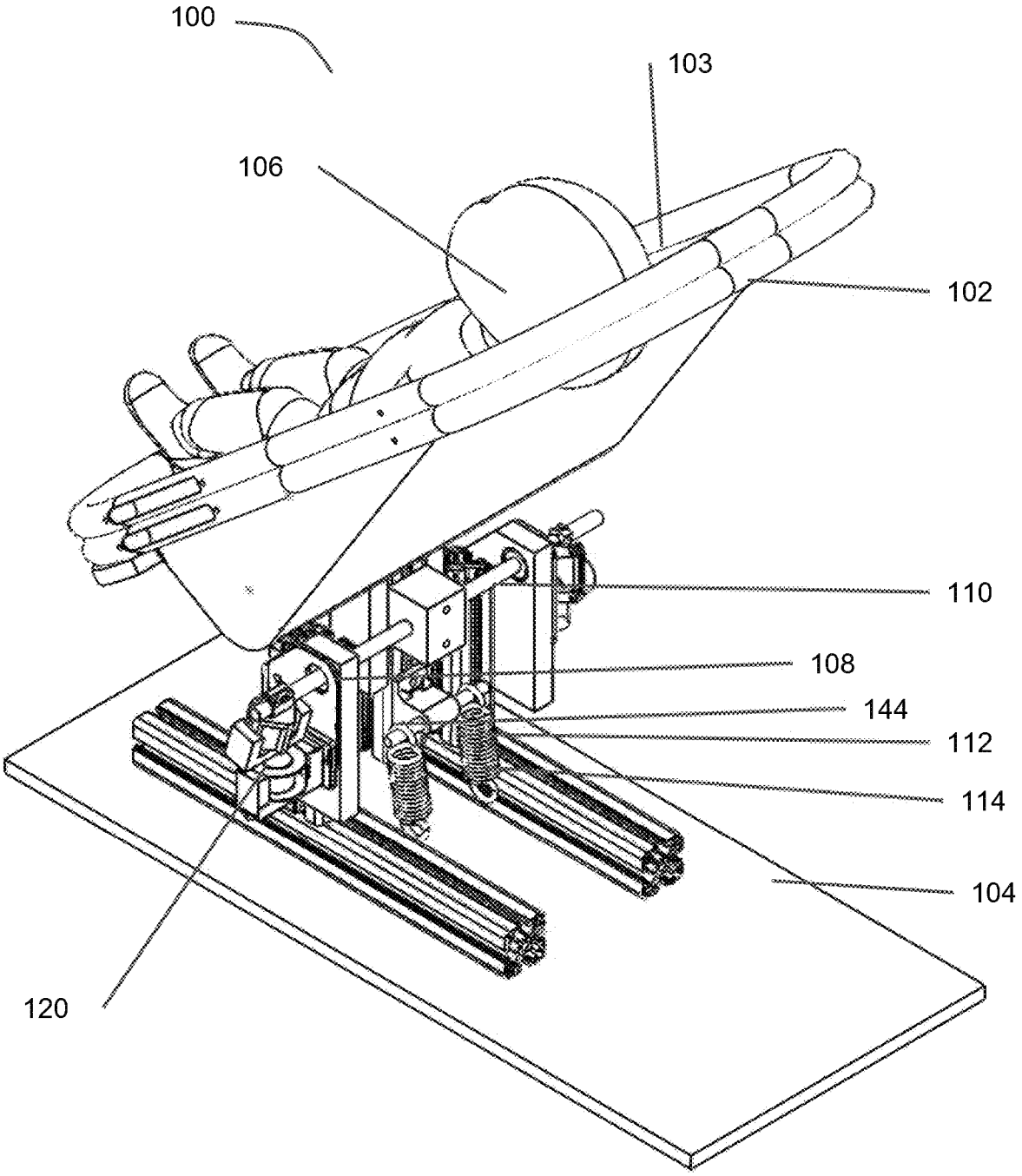
FIG. 1*a* shows a baby bouncer according to some embodiments.

With reference to FIG. 1*a*, there is provided a baby bouncer 100 comprising a seat 102 and a base 104. The seat 102 is configured to receive a baby 106. The seat 102 may be sized such that the baby 106 may fit snugly into the seat 102. In at least one configuration, the seat 102 may be substantially concave with respect to a baby receiving portion 103 of the seat 102, such that the baby 106 may be partially enclosed or ensconced with the seat 102. The seat 102 is connected to the base 104 via a joint 108. The joint 108 supports the seat 102 above the base 104 when, in use, the base 104 is placed on the ground or any suitable supporting surface. The joint 108 is configured to permit a reciprocating motion of the seat 102 relative to the base 104. For example, the joint 108 may comprise a hinge or an axle 110. The hinge or axle 110 may support the seat 102 rotatably above the base 104 and allow rotation of the seat 102 relative to the base 104. The hinge or axle 110 may support the seat at a central position. A resilient member 112 such as coil spring 114 may be connected to the seat 102 and to the base 104 to provide a restoring force to return the seat 102 to the central position above the base. When the seat 102 is deflected in either direction, causing a rotation of the seat 102 about the joint 108, the resilient member 112 or coil spring 114 may longitudinally extend and exert a restoring force to deflect the seat 102 back to the central position. Whilst a coil spring 114 is shown in FIG. 1*a*, the skilled person will appreciate that any suitable resilient member 112 may be used to return the seat towards the central position after the seat has been deflected. For example, a flexing spring may be used or a rubber pad. Alternatively or additionally, any suitable extension spring may be used. For example, an elastic cord or a bungee.

The hinge or axle 110 may be disposed horizontally with respect to the base 104. That is, the hinge or axle 110 may be oriented such that rotating the seat 102 about the joint 108 results in a substantially vertical bouncing motion.

In an alternative embodiment, the joint 108 may itself comprise a resilient member configured to support the seat at a central position above the base. For example, instead of including an axle or hinge, the joint 108 may comprise a resilient material which allows the seat 102 to deflect by elastically deforming. The resilience of the resilient material may provide the restoring force to return the seat 102 to the central position after the seat has been deflected.

In an embodiment, the baby bouncer 100 may comprise an adjustment member connected to the resilient member 112 and configured to adjust a preload applied to the resilient member 112. For example, the adjustment member may comprise a dial or a threaded knob configured to adjust the length of the resilient member 112 when the seat is in a central position. By changing the amount of preload on the resilient member 112, the characteristics of the baby bouncer 100 may be adjusted. For example, by increasing the preload on the resilient member 112, the natural frequency of the oscillations of the seat 102 may be greater. By decreasing the preload on the resilient member, the natural frequency of the oscillation of the seat 102 may be lower. Adjustment of the preload of the resilient member 112 may be done to change the oscillation frequency or to maintain a given oscillation frequency under a different weight occupant.

The baby bouncer 100 may further comprise an actuator 120 connected between the base 104 and the seat 102. The actuator 120 is configured to impart a driving force on the seat 102. The actuator 120 may be an electromagnetic actuator, and the driving force may be a magnetic force.

Figure 1B:
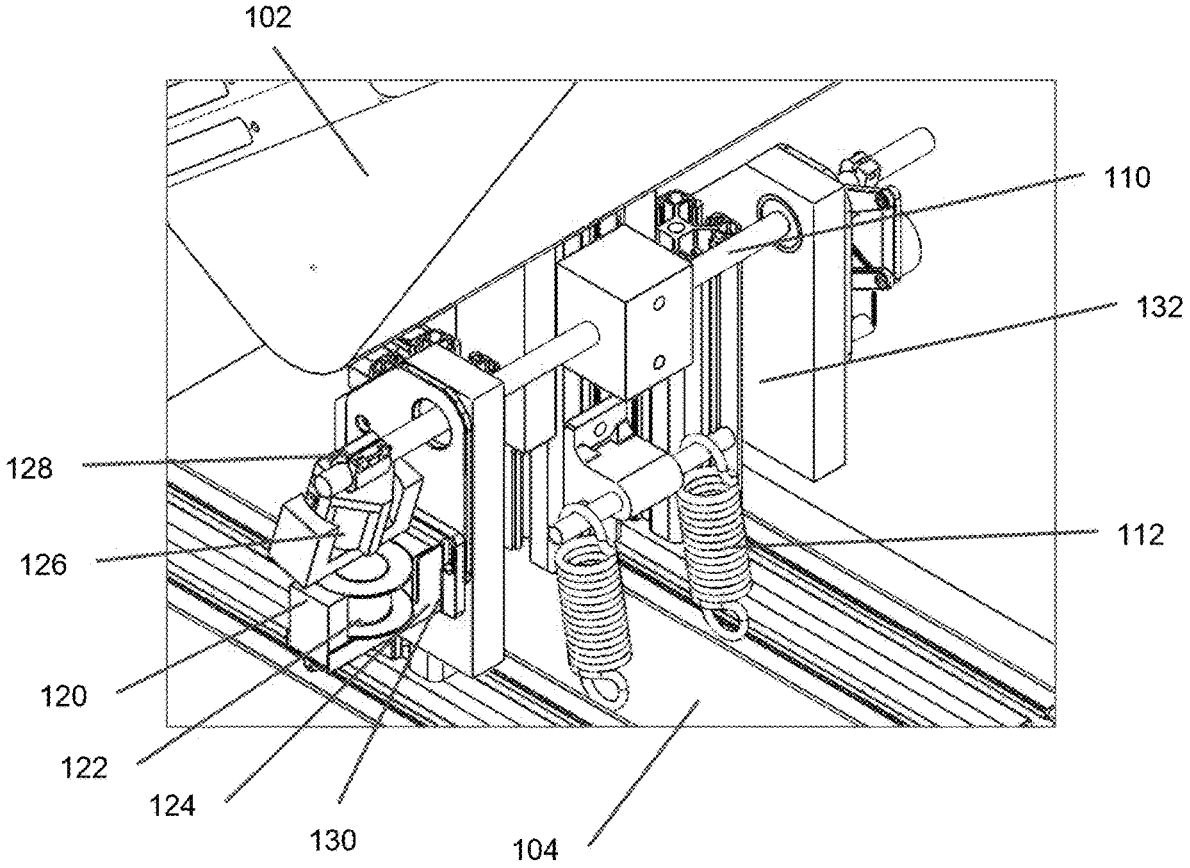
FIG. 1*b* shows an enlarged view of the baby bouncer of FIG. 1*a*.

Turning to FIG. 1*b*, which shows an enlargement of the central part of FIG. 1*a*, there can be seen the actuator 120 connected between the base 104 and the seat 102. The electromagnetic actuator 120 comprises an electromagnetic coil 122 fixed to the base 104. The electromagnetic coil 122 may be fixed to the base 104 via a coil mounting 124. The electromagnetic actuator 120 may also comprise a magnetic material 126 in proximity to the electromagnetic coil 122. The magnetic material 126 may be fixed to the seat 102 via a magnet mounting 128. The magnetic material 126 may be a permanent magnet, a ferromagnetic material, or an electromagnet itself. In any case, the magnetic material 126 is configured to interact with the electromagnetic coil 122 to provide a driving force on the seat 102. As shown in FIG. 1*b*, the magnetic material 126 is fixed to the seat 102 via the axle 110. When the seat 102 is in the central position (as depicted in FIGS. 1*a* and 1*b*), the magnetic material 126 is positioned in proximity to the electromagnetic coil 122 such powering the electromagnetic coil 122 urges the magnetic material 126 to move closer to the electromagnetic coil 122 (i.e. the electromagnetic coil 122 attracts the magnetic material 126). Since the magnetic material 126 is fixed to the axle 110, by urging the magnetic material 126 to move closer to the electromagnetic coil 122, the seat 102 is deflected in a first direction.

Whilst it has been shown in FIGS. 1*a* and 1*b* that the electromagnetic coil 122 may be fixed to the base 104 and the magnetic material 126 may be fixed to the seat 102, it is within the scope of this disclosure that the electromagnetic coil 122 and the magnetic material 126 may be in alternate positions. For example, the electromagnetic coil 122 may be fixed to the seat 102 and the magnetic material 126 may be fixed to the base 104. In the example shown in FIGS. 1*a* and 1*b*, it is advantageous to locate the electromagnetic coil 122 on the base 104 to reduce the complexity of including electrically powered components on a moving part (i.e. the seat 102).

The baby bouncer 100 may further comprise an electrical driver. The electrical driver is configured to drive the electromagnetic coil 122 with an electric current. The electrical driver may be connected to the electromagnetic coil 122 via wires or another electrical connection. The electrical driver may be configured to provide an electric current flowing in a first direction in the coil 122 such that the coil 122 attracts the magnetic material 126.

In an alternative embodiment, the electrical driver may be configured to provide an electric current flowing in a second direction in the coil 122 such that the coil 122 repels the magnetic material 126. In such a case, the magnetic material 126 may be a permanent magnet or an electromagnet having a corresponding magnetic field.

The electromagnetic actuator may further comprise a load cell 130 configured to detect the force applied by the electromagnetic actuator 120. The load cell 130 may be a conventional load cell 130 configured to provide a voltage at a load cell output which is dependent on the load applied to the load cell 130. The load cell 130 may be connected to the electrical driver such that the electrical driver may be configured to respond to load measurements from the load cell 130. For example, the baby bouncer 100 may be configured such that the electromagnetic actuator 120 ceases to drive the seat 102 relative to the base 104 when the force detected by the load cell 130 exceeds a predefined threshold. The predefined threshold may be set at a level so as to prevent damage to a user or the product in use. For example, if the seat 102 becomes trapped in position or caught in the environment (e.g. when the seat is placed in an inappropriate position, pressing against a couch or other furniture) the load cell 130 may provide an indication that the load applied by the actuator is too great, and the electromagnetic actuator 120 may cease to drive the seat 102. In another example, the seat 102 may be occupied by an inappropriate user (such as an adult, or older child) whose weight exceeds what the baby bouncer 100 is designed to accommodate. In such an instance, the load measure by the load cell 130 may exceed the predefined threshold and the electromagnetic actuator 120 may cease to drive the seat 102 relative to the base 104.

The load cell 130 may be configured to detect the force applied by the electromagnetic actuator 120 to determine the mass of the occupant. For example, the force applied by the electromagnetic actuator 120 would be larger to achieve a given acceleration of the seat 102 including the occupant if the occupant of the seat 102 has a greater mass, consistent with Newton's second law of motion. By determining the force from the load cell 130, and the known acceleration of the seat 102, the mass of the occupant may be calculated from the force divided by the acceleration. In an embodiment, the mass of the occupant may be monitored or tracked over a period of time, or multiple uses of the baby bouncer 100 to determine the weight change of the occupant.

The load cell 130 may be configured to detect the force applied by the electromagnetic actuator 120 to determine a degree of movement of the occupant of the seat 102. For example, a baby in the baby bouncer 100 may move around within the seat 102. The motion of the baby in the baby bouncer 100 will cause a shift in the centre of mass of the baby in the baby bouncer which is detectable by the load cell 130. In an embodiment, the baby bouncer 100 may be configured to detect an intensity of the movement of the centre of mass by measurement of the force applied to the load cell 130 and provide feedback based on the detected movement. The feedback may include data presented to a user, or altering the operation of the baby bouncer 100 in response to the detected movement. In this way, the baby bouncer 100 may be configured to operate at a different frequency or amplitude in response to a detected movement in the seat 102. In a further embodiment, the movement detected in the seat 102 by the measurement from the load cell 130 may provide an indication that an occupant is awake or asleep. The indication that an occupant is awake or asleep based on the movement detected in the seat 102 may be used to track the sleep of the baby.

Additionally or alternatively, a load cell 130 may be located on the base 104 of the baby bouncer 100. Where the load cell 130 is located on the base 104 of the baby bouncer 100, the load cell 130 may provide a measurement of the force applied between the base 104 and the floor on which the base 104 is supported. The load cell 130 located on the base 104 may provide indications of occupant weight and/or forces being applied to the seat 102 when oscillating by detecting the reactive force between the base 104 and the ground in reaction to the occupant's weight and the motion of the seat 102.

The actuator 120 may be releasably connected between the base 104 and the seat 102. That is, the actuator 120 may be removably coupled to the base 104 and the seat 102 such that the seat 102 may be manually manipulated without the presence of the actuator 120. The actuator 120 may be retrofitted or attached to a baby bouncer 100 which did not previously include an actuator 120 to provide the additional functionality of the actuator 120. The actuator 120 may be disconnected from the base and disconnected from the seat 102 to provide, for example, a bouncer 100 which may be safely transported in the hold of an aircraft. The actuator 120 may include a battery power source or other electrical equipment which may not be safely transported in the hold of an aircraft. By removing the actuator 120, the bouncer 100 may be allowed on flights. The actuator 120 may be small enough on its own that a user may transport the actuator 120 in the cabin of a passenger flight, or discarded such that the bouncer 100 may be operated manually until the actuator 120 is reattached. This may be useful for travel, where the bouncer 100 may be taken in its lightweight manual form for a short trip, but the full functionality restored by reattaching the actuator 120 at a later date.

Figure 2:
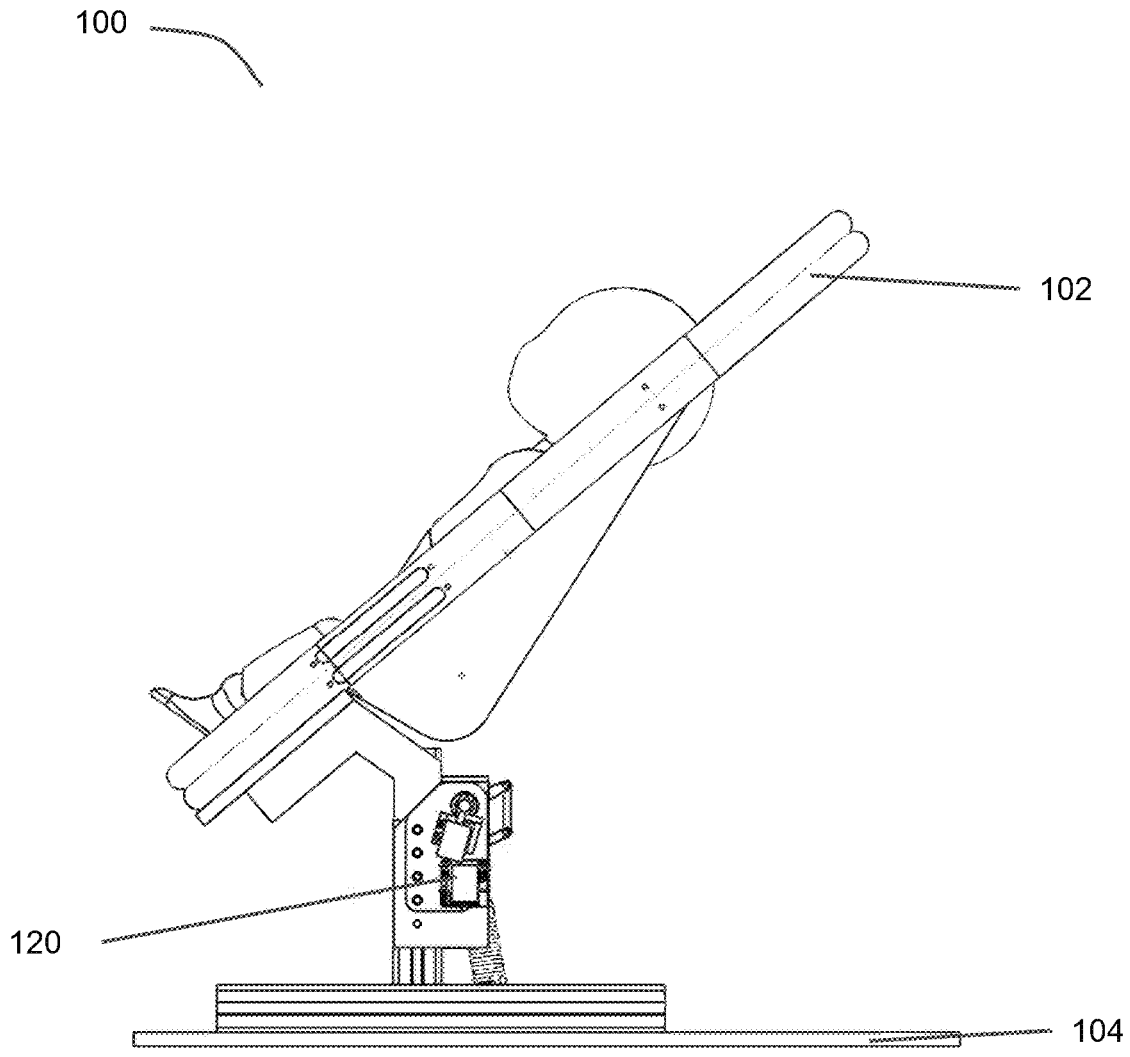
FIG. 2 shows a side view of the baby bouncer of FIG. 1*a*.
Figure 3:
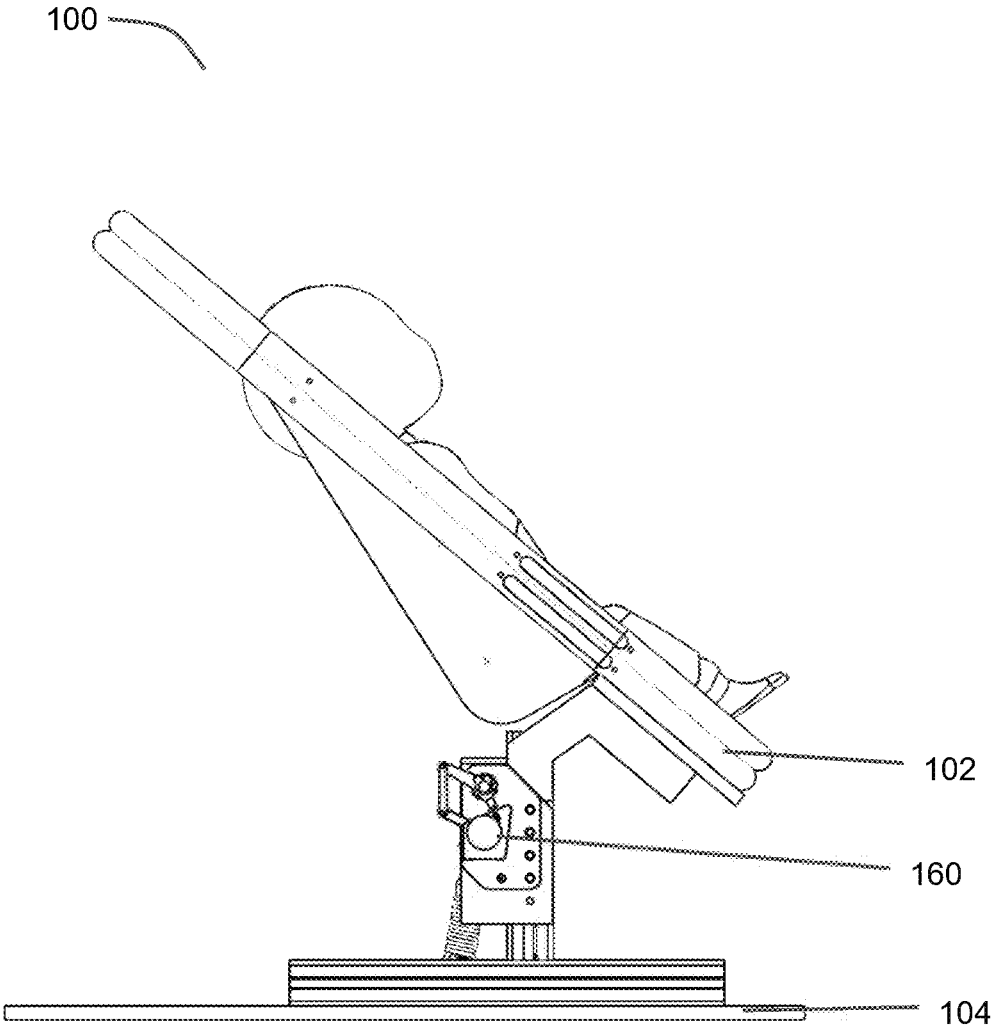
FIG. 3 shows another side view of the baby bouncer of FIG. 1*a*.

Turning to FIGS. 2 and 3, the baby bouncer 100 is shown from a first side and a second side. From the first side shown in FIG. 2 (the right side of the device as viewed by a parent user from the front of the bouncer) the actuator 120 can be seen, as well as the geometry of the embodiment shown in FIGS. 1*a* and 1*b*. From the second side shown in FIG. 3 (the left side of the device as viewed by a parent user from the front of the bouncer) the sensor 160 can be seen.

Figure 4:
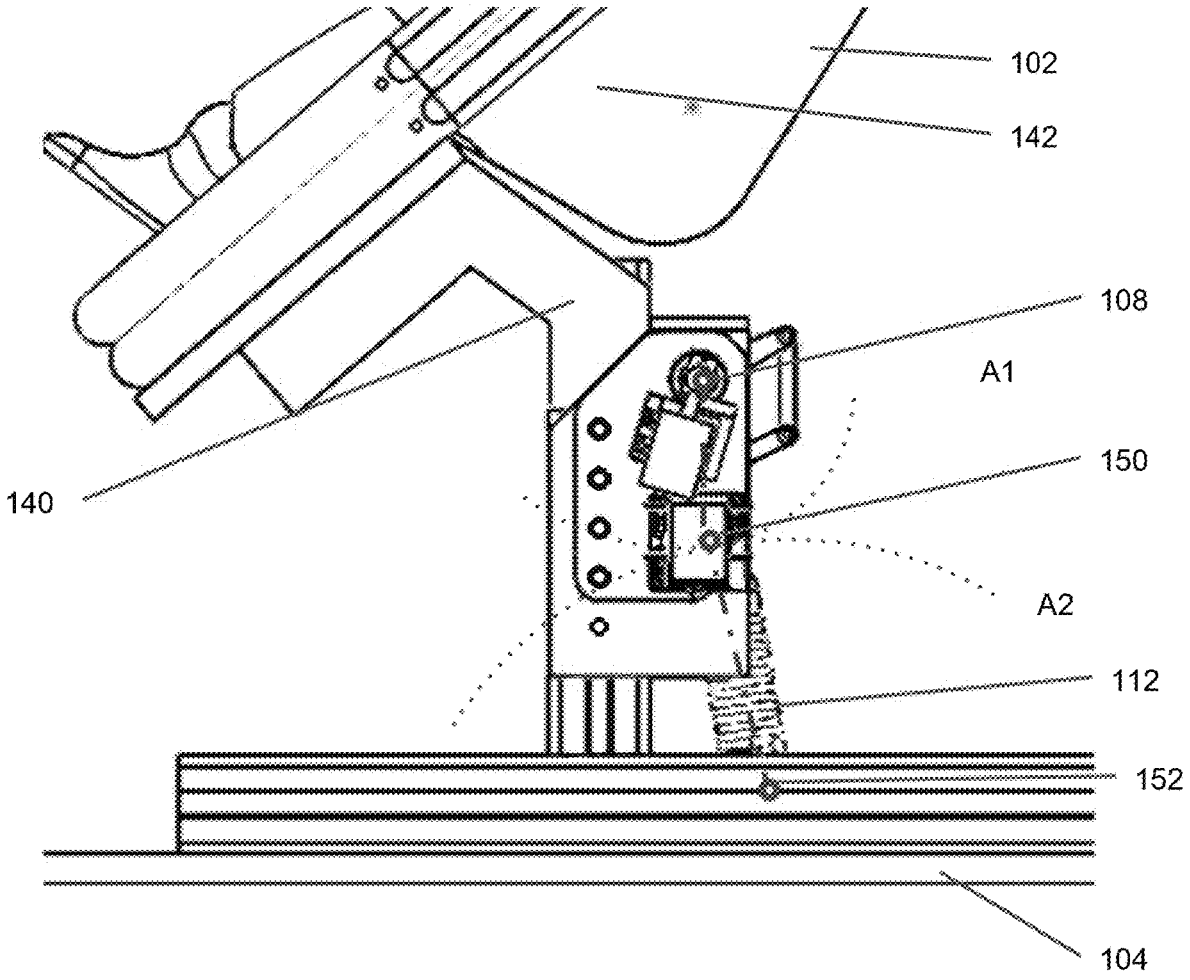
FIG. 4 shows an enlarged view of the baby bouncer shown in FIG. 2.

FIG. 4 shows an enlargement of the first side view of FIG. 2. As can be seen in FIG. 4, the seat 102 is connected to the base 104 via the joint 108. The joint 108 is located at a first height above the base 104 (in the vertical direction as shown in FIG. 4), and at a first lateral position with respect to the base 104 (in the horizontal direction as shown in FIG. 4). In the embodiment shown in FIG. 4, the joint 108 comprises an axle 110 about which the seat 102 is configured to rotate. The seat 102 comprises a swingarm 140 and a baby receptacle 142. The baby receptacle 142 is the part of the seat 102 which receives a baby and provides support to the baby (e.g. it includes a seat back and a seat bottom for the baby to sit on). The swingarm 140 extends substantially from the baby receptacle 142. As shown in FIG. 4, the swingarm 140 extends downwardly from the baby receptacle 142 and provides the connection to the hinge or axle 110. The swingarm 140 extends past the hinge or axle 110. The extension of the swingarm 140 past the hinge or axle 110 can be more readily seen in FIG. 1*a* which shows a rear three quarters view of the baby bouncer 100. As shown in FIG. 1*a*, the swingarm 140 extends past the hinge or axle 110 to an end 144 of the swingarm 140.

The extension spring 112 is connected between the base 104 and the seat 102. As shown in FIG. 4, the extension spring 112 may be connected to the seat 102 at a first connection point 150. The first connection point 150 may be a connection point on the swingarm 140 at a location beyond the hinge or axle 110 with respect to the baby receptacle 142. The first connection point 150 may be a connection point on the swingarm 140 proximate to the end 144 of the swingarm 140. The extension spring 112 may be connected to the base 104 at a second connection point 152. The second connection point is located at a second height relative to the base. The second height relative to the base may be a height above the base 104, below the base 104, or the second height may be zero (i.e. the second connection point is located on the base). The second connection point 152 may be located at a second lateral position relative to the base 104. The first connection point 150 may be located on a straight line between the joint 108 and the second connection point 152. It will be appreciated that, in use, the first connection point 150 will deflect away from being located exactly on a straight line between the joint 108 and the second connection point 152. Where the first connection point 150 is deflected in use, the first connection point 150 may lie substantially on a straight line between the joint 108 and the second connection point 152. The central position of the seat 102 may be configured such that when the seat is in the central position, the first connection point 150 lies on a straight line between the joint 108 and the second connection point 152. Furthermore, the seat 102 may be deflected under the weight of a baby such that the central position of the seat 102 is dependent on the weight of the baby. In use, the first connection point 150 may pass through a location where the first connection point lies on a straight line between the joint 108 and the second connection point 152. The straight line may be considered from the perspective of the first side or the second side of the baby bouncer 100, in that the straight line may be drawn perpendicular to a viewing angle from the side of the baby bouncer 100.

The first connection point 150 may travel along a first arc A1 when the seat 102 is deflected. The first connection point 150 may rotate about the joint 108 scribing the first arc A1. If the extension spring 112 were to rotate about the second connection point 152 without extending or compressing, the end of the spring connected to the swingarm 140 at the first connection point 150 would follow a second arc A2. To put it another way, a second arc A2 may be scribed as a constant radius about the second connection point 152 overlapping with the first arc A1 at a single point.

Figure 5:
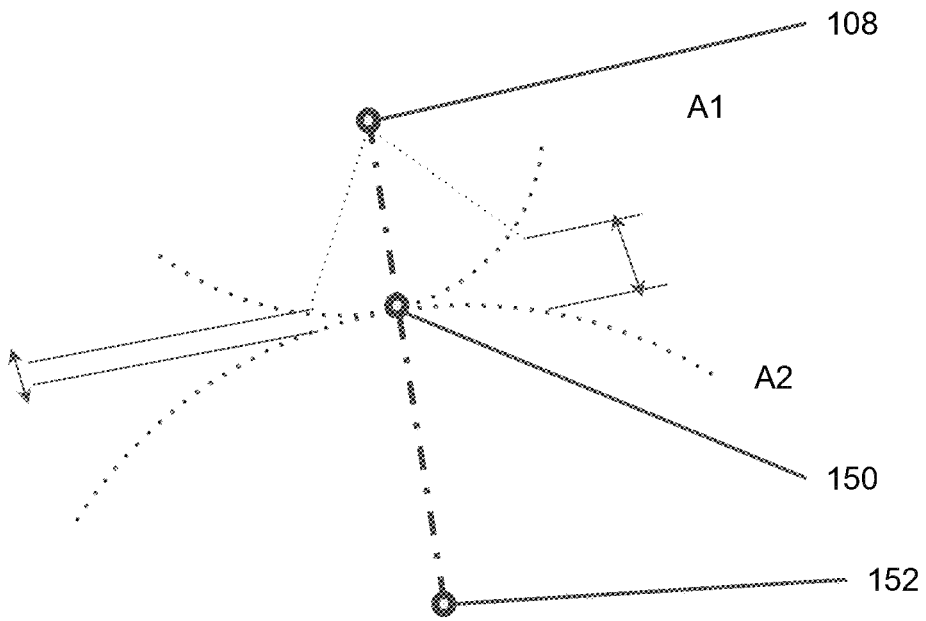
FIG. 5 shows an abstraction of the geometry of the baby bouncer shown in FIG. 4.

FIG. 5 shows a schematic of the overlaid geometry of FIG. 4. Turning to FIG. 5, the effect of this geometry may be more clearly seen. Deflecting the seat 102 causes the first connection point 150 to rotate about the joint 108 along the first arc A1. When the seat 102 is deflected away from the central position shown in FIG. 5, the extension spring 112 will rotate about the second connection point 152 and extend to connect the greater distance between the second connection point 152 and the first connection point 150. The extension of the extension spring 112 can be seen in FIG. 5 as the distance between the first arc A1 and the second arc A2. When the seat 102 is in the central position, the distance between the first connection point 150 on the first arc A1 and the second connection point 152 on the second arc A2 is relatively small, and when the seat 102 has been deflected, the distance between the first connection point 150 on the first arc A1 and the second connection point 152 on the second arc A2 is relatively large. Since the first connection point follows the first arc A1, and the zero extension radius of the extension spring follows the second arc A2 which curve in opposite directions, deflection of the seat 102 by a set amount at the central position causes a small extension of the extension spring 112, whereas deflection of the seat 102 by the same unit amount at a point away from the central position causes a relatively larger extension of the extension spring 112. Based on the spring rate of the extension spring 112 and the angle at which the extension spring 112 provides a restoring force to return the seat 102 to the central position, the rate of change of the restoring force provided by the extension spring 112 proximate the central position is less than the rate of change of the restoring force provided by the extension spring 112 distant from the central position.

Figure 6:
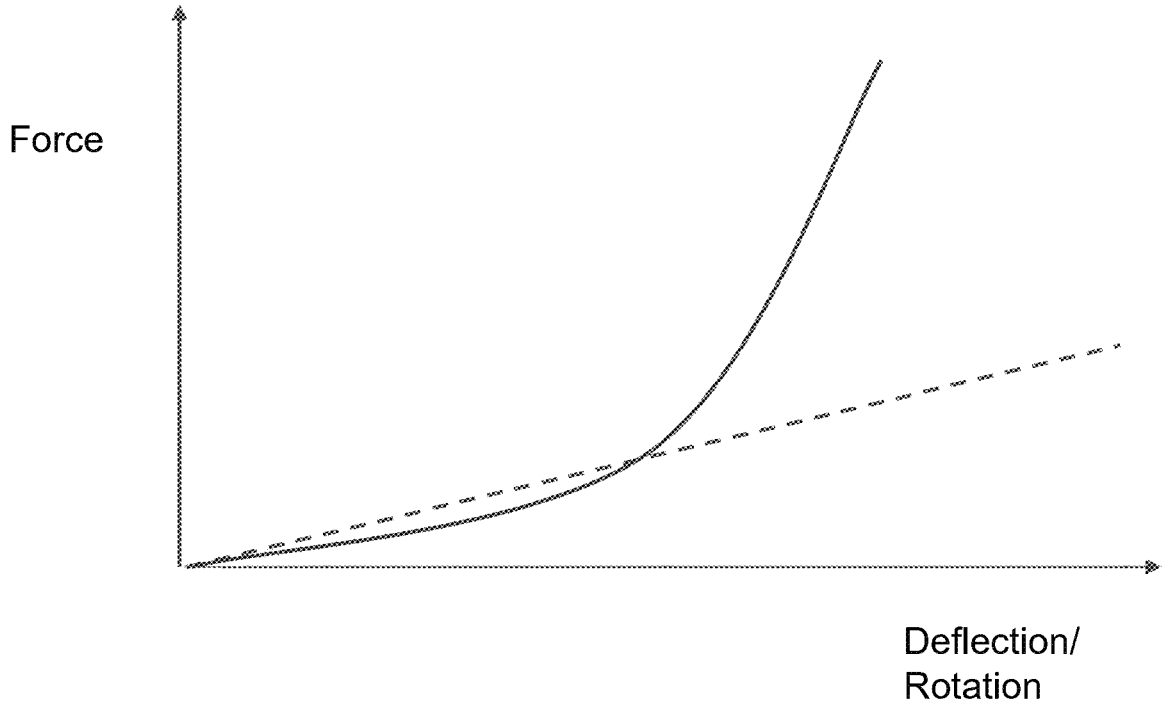
FIG. 6 shows an exemplary chart of the variable rate geometry.

FIG. 6 shows the variable rate of restoring force. FIG. 6 shows the relative restoring force of a linear resilient element providing a restoring force to a central position compared to the variable rate geometry of the present embodiment. The broken line depicts a linear spring restoring force. A linear spring restoring force is the resilient force provided by a linear spring in a direction opposite to the direction of the extension of the spring. The solid line depicts an exemplary restoring force provided by the present disclosure. At small amounts of deflection, the restoring force is relatively low. At larger deflections, the restoring force is greater than that which would be expected from a linear response of a linear spring. An effect of such a variable rate geometry is that the bouncer may provide consistent operation over a range of baby weights and/or power delivery from an actuator. Another effect of the variable spring rate geometry provided by the present disclosure is that a bouncer or swing in which the variable rate geometry is implemented will allow relatively large movement under the low forces experienced in use with a small infant, but the movement experienced in use with a larger infant will not be excessive.

In the embodiment shown in FIGS. 1*a* and 4, the hinge or axle 110 is supported by a post 132 which extends upwardly from the base 104. The baby bouncer 100 may comprise one or a plurality of posts 132 to support the joint 108 or the hinge or axle 110. In an alternative, the hinge or axle may be supported by other means, such as suspended from a support or cantilever.

Furthermore, in the embodiment shown in FIGS. 1*a* and 4, the joint 108 is configured such that the reciprocating motion of the seat extends in a substantially vertical direction with respect to the base 104. However, similar effects may be realised by providing a reciprocating motion in other directions. For example, the disclosure may be applied to other infant soothing devices including but not limited to swings and rockers. The infant soothing devices may comprise a stand, an infant receiving portion rotatably mounted on the stand, and a biasing means connected to the infant receiving portion and configured to cause a rotation of the infant receiving portion relative to the stand. It will also be appreciated that the configuration of springs described herein may be implemented in almost any orientation. Springs may be positioned in any direction about a pivot point and achieve the same or similar effects, so long as the relative extension or compression of the springs with respect to a central position of the seat is comparable. The biasing means may be active, in that it provides a controlled driving force (such as actuator 120), and optionally the active biasing means may be electrically controlled (such as electromagnetic actuator 120). For example, the active biasing means may comprise one or more of an electrical coil, a coil spring, a leaf spring, a pneumatic chamber, and a hydraulic chamber.

Whether the infant soothing device is a swing, a rocker, or a bouncer, the infant receiving portion may be rotatably mounted on the stand such that the infant receiving portion extends vertically away from the stand, or such that the infant receiving portion extends horizontally away from the stand. In this way, the infant receiving portion may include substantially vertical oscillation, substantially horizontal oscillation, or a combination of vertical and horizontal oscillation.

The baby bouncer or infant soothing device may be configured such that the reciprocating motion follows a path, and that path may be linear (bouncing back and forth), circular (following an arc), elliptical (following an arc with a varying radius), or a figure of 8 (a combination of two oscillations in perpendicular directions).

The baby bouncer 100 may comprise a sensor 160 configured to detect the deflection of the seat 102 relative to the base 104. The sensor 160 may directly detect the deflection of the seat 102 such as in the case of an optical encoder, or the sensor may indirectly detect the deflection of the seat by measuring the velocity of the seat (for example by using a electromagnetic encoder or back EMF measurement), or by measuring the acceleration of the seat (for example by using a gyroscope or an accelerometer). The sensor 160 may indirectly measure the deflection of the seat by integration of the velocity or the acceleration measurements. The sensor may comprise a Micro Electromechanical Sensor or MEMS device.

Back EMF measurement to sense the velocity of the seat may be achieved in combination with an actuator 120 which comprises an electromagnetic coil and a magnet. The motion of the magnet relative to the electromagnetic coil may be recorded independently of the drive motions being applied (e.g. by filtering the drive signal or by measuring the voltage across and current flowing through the electromagnetic coil) since the motion of the electromagnetic coil in the magnetic field provided by the magnet causes a voltage across the electromagnetic coil in series with the driving voltage.

Where the actuator 120 comprises an electromagnetic coil and a magnetic component which is not a permanent magnet, the electromagnetic coil may be used as an electromagnetic encoder. For example, the inductance of the electromagnetic coil may be measured (e.g. in response to one or more frequencies of applied alternating current). As the electromagnetic coil is moved closer to the magnetic component (e.g. a ferromagnetic component), the inductance of the electromagnetic coil increases. As the electromagnetic coil is moved further from the ferromagnetic component, the inductance of the electromagnetic coil decreases. The increase or decrease of the inductance provides an indication of the position of the seat 102 with respect to the base 104.

The sensor may be connected to a processor which may be part of a microcontroller configured to control the baby bouncer 100. The processor may be configured to read measurements from the sensor 160 and derive the velocity of the seat 102 relative to the base 104 by taking multiple measurements of deflection over time, or by numerical integration of the acceleration of the seat 102. Alternatively, the processor may receive a direct measurement of the velocity of the seat 102 from the sensor 160. The measurement of velocity of the seat 102 may include a direction and a magnitude.

The detection of a velocity of the seat 102 in a first direction may be used as a means of controlling the electromagnetic actuator 120 (or an alternative actuator) to drive the seat 102 in the first direction. To put it another way, the electromagnetic actuator may be configured to drive the seat 102 in the first direction when the seat 102 is detected to be already moving in the first direction according to the signal from the sensor 160.

When the seat 102 reaches the end of travel in the first direction, for example because the restoring force of the resilient member 112 overcomes the driving force driving the seat 102 in the first direction, the sensor 160 will no longer detect a velocity of the seat 102 in the first direction. Since the sensor 160 no longer detects a velocity of the seat 102 in the first direction, the actuator 120 may be configured to no longer drive the seat 102 in the first direction. In the example shown in FIGS. 1*a* and 1*b*, the driving of the seat 102 in the first direction may be achieved by delivering electrical power to the electromagnetic actuator 120, and when the sensor 160 no longer detects a velocity of the seat 102 in the first direction the delivery of electrical power to the electromagnetic actuator 120 may be switched off.

When the sensor 160 detects a velocity of the seat 102 in a second direction which is opposite to the first direction, this is an indication that the seat 102 is moving under the resilient restoring force provided by the resilient member 112. The electromagnetic actuator may be configured to not provide any driving force to the seat in either the first or second direction when the sensor 160 provides an indication that the seat 102 is moving in the second direction.

As the seat 102 continues to move in the second direction opposite to the first direction, the seat 102 will move past the midpoint of the oscillating motion shown in FIG. 4, and the resilient member 112 will begin to provide a restoring force acting in the first direction. The seat 102 continues to move in the second direction until the seat 102 reaches an end point of travel in the second direction, i.e. when the restoring force of the resilient member 112 overcomes the inertia of the seat moving in the second direction. At the end point of travel in the second direction the seat 102 will begin to move again in the first direction under the driving force of the resilient member 112. However, in addition to the driving force provided by the resilient member 112, the sensor 160 detects a velocity of the seat 102 in the first direction and, in response, the electromagnetic actuator 120 is configured to provide a driving force in the first direction. Since the electromagnetic actuator 120 provides an input of energy to the seat 102 in the first direction every time the seat is moving with a velocity in the first direction, any energy lost from the seat due to friction, air resistance, motion or wriggling of the infant, or minor interference with the seat (such as brushing against a hand or leg of an adult) may be restored to the seat 102 to maintain the amount of energy in the seat 102 and maintain the oscillating motion of the seat 102.

Figure 7:
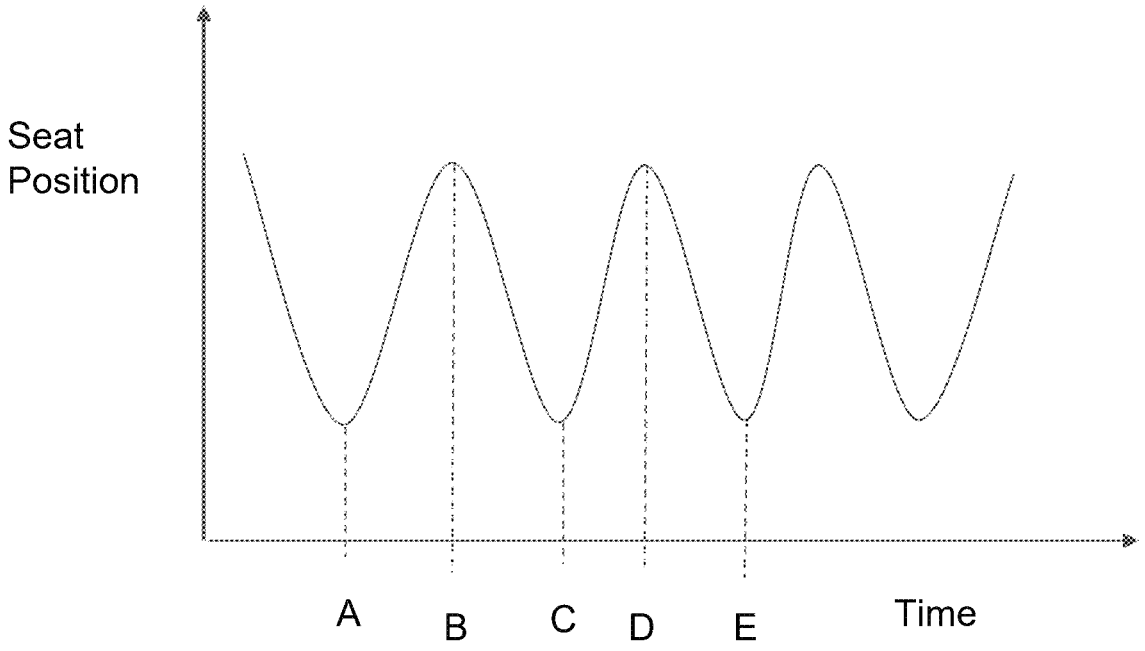
FIG. 7 shows a graph of the oscillation of a baby bouncer.

FIG. 7 shows a graph of the motion of the seat 102 over a time period oscillating according to the embodiments disclosed herein. Greater values of seat position in the graph shown in FIG. 7 correspond to a position further in the first direction, whereas lesser values of seat position in the graph correspond to a position further in the second direction. At point A in the graph, the seat is in the maximum displacement in the second direction of the oscillating motion. As the seat moves from point A to point B, the seat velocity is detected by the sensor 160 to be in the first direction and a driving force is provided by the electromagnetic actuator 120 in the first direction. At point B, the seat 102 is in the maximum displacement position in the first direction and so the sensor 160 detects no velocity of the seat 102 and the electromagnetic actuator 120 provides no driving force. As the seat moves from point B to point C, the sensor 160 detects a velocity of the seat 102 in the second direction and the electromagnetic actuator provides no driving force to the seat 102.

In an alternative embodiment, the electromagnetic actuator may be configured to provide a driving force in the first direction every other oscillation. For example, the electromagnetic actuator 120 may provide a driving force from point A to point B, no driving force between points B and E, and repeating the pattern from point E. In another alternative the actuator 120 may provide a first driving force in the first direction when the seat 102 is moving in the first direction, and a second driving force in the second direction when the seat 102 is moving in the second direction. For example, the first driving force in the first direction may be provided between points A and B, and points C and D. The second driving force in the second direction may be provided between points B and C, and points D and E. Electromagnetic force in the second direction may be provided by reversing the polarity of voltage applied to the actuator or reversing the direction of current flow provided to the actuator 120. This may work if the magnetic material 126 has its own magnetic field (e.g. it is a permanent magnet or an electromagnet being powered).

In use, an adult bouncing the bouncer may wish to provide a certain degree of bouncing amplitude and for that bouncing amplitude to be maintained without depreciating too quickly. The sensor may be configured to detect a maximum displacement of the seat relative to the base when the electromagnetic actuator 120 is not providing a driving force. For example, the adult may provide a manual or hand input to the bouncer and the sensor 160 may detect the maximum displacement of the seat 102 under the manual or hand input.

Subsequently, the sensor 160 may detect the current displacement of the seat 102 relative to the base 104 when the electromagnetic actuator 120 is providing the driving force. In this way, the sensor 160 may provide an indication of the desired displacement (i.e. the maximum displacement under manual input) and the current displacement (i.e. that displacement being achieved under actuator driven oscillation) and determine whether the current displacement is less than the desired displacement, the same as the desired displacement, or more than the desired displacement. The sensor 160 may provide an indication that there is no displacement of the seat 102 at all.

Figure 8:
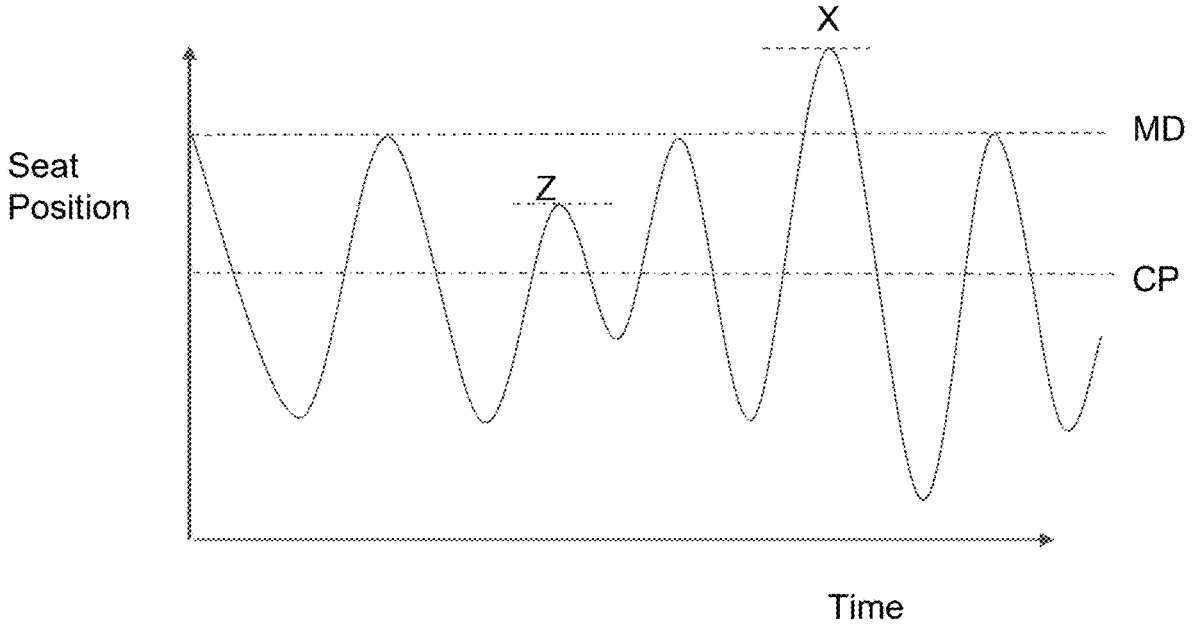
FIG. 8 shows a graph of the correction of the oscillation of a baby bouncer.

FIG. 8 shows the impact on the oscillation that control of the maximum displacement in embodiments of the disclosure may have. FIG. 8 shows the position of the seat 102 with respect to the base 104 in a first direction (greater values of seat position) and a second direction (lesser values of seat position) opposite to the first direction. The centreline CP in FIG. 8 shows the midpoint of the oscillation of the seat 102. The broken line MD shows the maximum displacement of the seat 102 used for control of the bouncer. The maximum displacement MD may be determined as described above, by recording the maximum displacement of the manual or hand input to the bouncer. On the first bounce shown in FIG. 8, the seat 102 reaches exactly the maximum displacement MD desired. When the current displacement matches the maximum displacement MD, the actuator 120 may be configured to provide a first driving force in the first direction. On the second bounce, the current displacement only reaches a lesser value of displacement Z which is less than the desired or maximum displacement MD. When the current displacement is less than the maximum displacement MD, the actuator 120 may provide a greater driving force in the first direction which is greater than the first driving force. By providing a greater driving force, the current displacement of the seat 102 may reach closer to the maximum displacement MD on subsequent oscillations. Essentially, the actuator 120 provides a greater energy input to the seat 102 when the current displacement is detected to be less than the desired maximum displacement.

On the third bounce shown in FIG. 8, the current displacement reaches the maximum displacement MD and so the first driving force may be applied to the seat 102. However, on the fourth bounce, the increase in energy input to the seat 102 either by the actuator 120 or by external forces (for example an infant swinging its legs, or from interference from an adult or another child) causes the current displacement X to exceed the maximum displacement MD. In response the actuator 120 may provide a lesser drive force to deflect the seat 102 in the first direction (or no drive force). Alternatively the actuator 120 may provide no driving force to deflect the seat in the first direction. Further alternatively, the actuator 120 may provide a retarding force to the seat 102 by applying a driving force to the seat 102 in the second direction when the seat 102 is moving with a velocity in the first direction or by applying a driving force to the seat 102 in the first direction when the seat 102 is moving with a velocity in the second direction. Subsequently, on the fifth bounce, the current displacement returns to the value of the maximum displacement MD.

The sensor 160 may be configured to detect the maximum displacement MD in a detection mode initiated by a trigger. The trigger may be implemented by means of a button on the baby bouncer or in electronic communication with the baby bouncer. For example, an adult may press the button to initiate the detection mode and begin applying a manual input to the bouncer. After detecting the maximum displacement applied by that manual input, the baby bouncer may cease the detection mode and enter a driving mode in which the seat 102 is driven to the maximum displacement MD recorded in the detection mode. The detection mode may last for a predetermined time period or for a predetermined number of oscillations. Additionally, or alternatively the trigger may be implemented by a connected device, for example a cell phone, or a remote control, or a smart watch. Further additionally or alternatively, the detection mode may be triggered when deflection of the seat 102 relative to the base 104 exceeds a predetermined threshold. For example, when the sensor 160 detects that a manual input has displaced the seat beyond the predetermined threshold, the bouncer may automatically initiate the detection mode, record the maximum displacement MD, and maintain that displacement over a period of time. The button may be implemented by any conventional means, for example the button may comprise any of a mechanical switch, a membrane switch, a slider, a rotary knob or dial, a touch screen or touch sensitive panel, a capacitive contact sensor, a non-contact sensor, an infra-red sensor, a motion sensor, a foot switch, or a light sensor.

Alternatively, the maximum displacement MD may be recalled from memory in the bouncer, from a connected device, or from a server in communication with the baby bouncer. In this way, if the user has a preferred maximum displacement MD, this may be recalled to be used in subsequent sessions. Further, the preferred maximum displacement MD may be shared from the memory in the bouncer with a server in communication with the baby bouncer such that the preferred maximum displacement MD may be shared with other users or other devices (such as a second user baby bouncer).

The maximum displacement MD may be user adjustable. For example, the user may control the maximum displacement by interacting with controls on the baby bouncer or by interacting with controls displayed on a connected device (such as a remote control, cell phone, or smart watch).

The baby bouncer 100 may be configured to automatically switch off after a predetermined time period. For example, the actuator 120 may no longer provide a driving force after 10 minutes have elapsed. Additionally, or alternatively, the bouncer 100 may gradually reduce the maximum displacement MD over a time period until the seat 102 is no longer oscillating or until the seat may continue to oscillate at a low value of maximum displacement MD indefinitely.

Where the baby bouncer 100 is configured to automatically switch off after a predetermined time period, the predetermined time period may be determined based on a usage history of the baby bouncer 100. In one example, the baby bouncer 100 and/or a connected device may be configured to determine an age and/or a weight of an occupant. The weight of the occupant may be determined by the baby bouncer by measurement from the load cell 130. Alternatively, a user may input the occupant weight manually. The age of the occupant may be input based on the birth date of the occupant, or estimated based on the first date that the occupant used the baby bouncer 100. The predetermined time period may be determined based on the weight and the age of the occupant. For example, the predetermined time period may be found in a lookup table (LUT) corresponding to a list of suitable predetermined time periods for occupants of differing weights and ages. Alternatively, the predetermined time period may be determined by a calculation of the maximum safe time as a product of the weight and the age of the occupant (i.e. proportional to the weight of the occupant and proportional to the age of the occupant).

In an embodiment, if the sensor 160 or processor detects a sudden reduction in current displacement or that the seat 102 has stopped oscillating, the actuator 120 may cease to provide any further driving force until the bouncer operation has been reset. In this way, should an obstruction impinge on the seat 102 or should the bouncer fail in some way which prevents safe operation, the bouncer 100 will not continue to operate thereby reducing the risk of uncontrolled operation of the bouncer 100.

In an embodiment, the baby bouncer 100 comprises a harness sensor in communication with the processor. The baby bouncer 100 may be configured to cease providing any further driving force, or prevent any driving force from being applied when the harness sensor indicates that the harness is not secured.

In an embodiment, the baby bouncer 100 is configured to detect by the load cell 130 that the occupant is no longer in the seat 102 or has been removed from the seat 102. The baby bouncer 100 may be configured to cease oscillating when it has been detected that the occupant is no longer in the seat 102 or has been removed from the seat 102.

In an embodiment, the baby bouncer 100 comprises a contact sensor in communication with the processor. The contact sensor may indicate if the baby bouncer 100 is properly configured to achieve safe bouncing. For example, the contact sensor may provide an indication that the base 104 is in contact with the ground or a surface. The contact sensor may provide an indication that the baby bouncer 100 is folded or unfolded into the correct orientation (e.g. the baby bouncer 100 may include walls, legs, or other components which must be configured correctly for bouncing). The indication from the contact sensor that the base is in contact with the ground or that the baby bouncer 100 is in the unfolded configuration may unlock the actuator 120 such that driving motions may be applied to the seat 102.

In an embodiment, the actuator 120 may be configured to apply a braking force to the seat 102 in order to resist the oscillating motion of the seat 102. In this way, the actuator may slow the seat 102 to a stop faster than the seat 102 would naturally decay over time. The braking force may be applied by reversing the polarity of the voltage applied to the actuator 120, or the actuator may comprise a brake. For example, the actuator may comprise a mechanical friction brake or an electromagnetic brake.

Figure 9A:
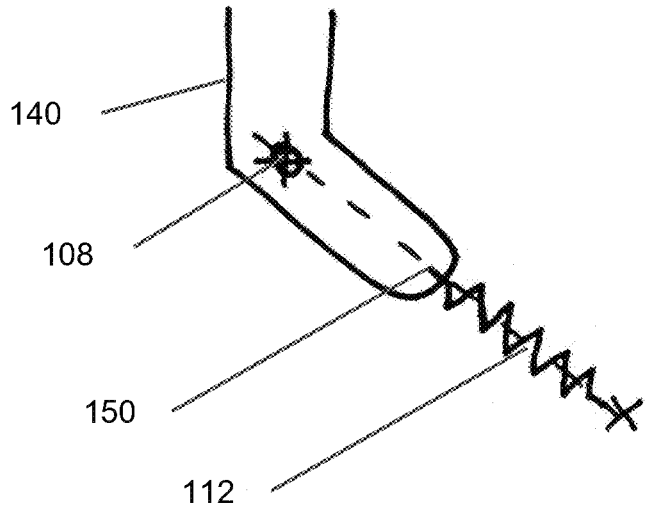
FIG. 9*a* shows a schematic of the extension spring according to an embodiment.
Figure 9B:
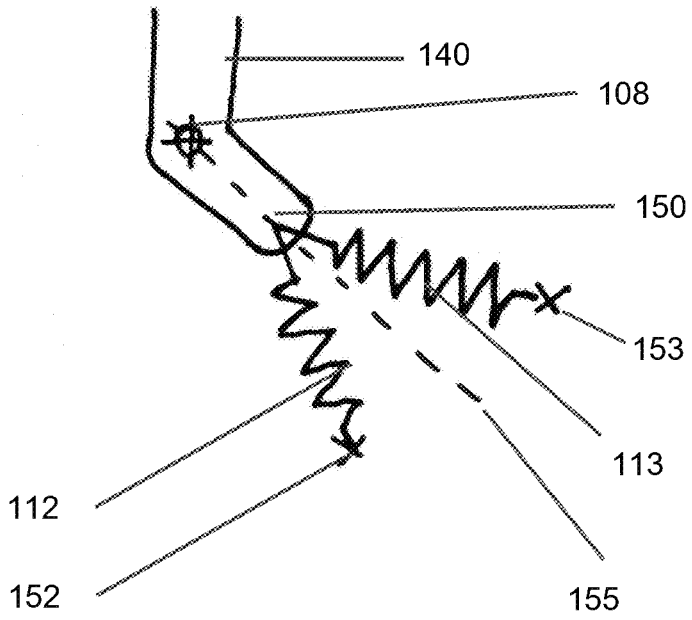
FIG. 9*b* shows a schematic of two extension springs according to an embodiment.

FIG. 9*a* shows an extension spring 112 connected between the base 104 and the seat 102 wherein the first connection point 150 is located on a straight line between the joint 108 and the second connection point 152 (as described with reference to FIG. 4 above). In an alternative arrangement as shown in FIG. 9*b*, an additional extension spring 113 may be connected between the base 104 and the seat 102. The extension spring 112 and the additional extension spring 113 may be connected to the seat 102 at the first connection point 150. The extension spring 112 is connected to the base 104 at the second connection point 152. The additional extension spring 113 is connected to the base 104 at a third connection point 153. The third connection point 153 is laterally and vertically offset from the second connection point 152. The extension spring 112 and the additional extension spring 113 may be positioned on either side of a straight line 155 extending through the joint 108 and the first connection point 150 when the seat 102 is in a central position. The first extension spring 112 which is on a first side of the central position and straight line 155 is positioned at a first angle with respect to the first connection point such that from the central position, movement of the seat 102 in a first direction will result in extension of the extension spring 112 and movement of the seat 102 in a second direction opposite to the first direction will not result in extension of the extension spring. The additional extension spring 112 which is on a second side of the central position and straight line 155 is positioned at a second angle with respect to the first connection point such that from the central position, movement of the seat 102 in the second direction will result in extension of the additional extension spring 113 and movement of the seat in the first direction will not result in extension of the additional extension spring 113. The extension spring 112 and the additional extension spring 113 may be a first spring and a second spring. It will be appreciated that more or fewer springs may be incorporated in the disclosed embodiments.

In an alternative embodiment, one or more of the extension spring 112 and additional extension spring 113 may be replaced with one or more of a torsion spring or a compression spring. For example, the extension spring 112 may be replaced with a compression spring, and the additional extension spring 113 may be replaced with a compression spring. In such a case, the additional compression spring may compress when the seat moves in the first direction and the compression spring may compress when the seat moves in the second direction opposite to the first direction.

Figure 10:
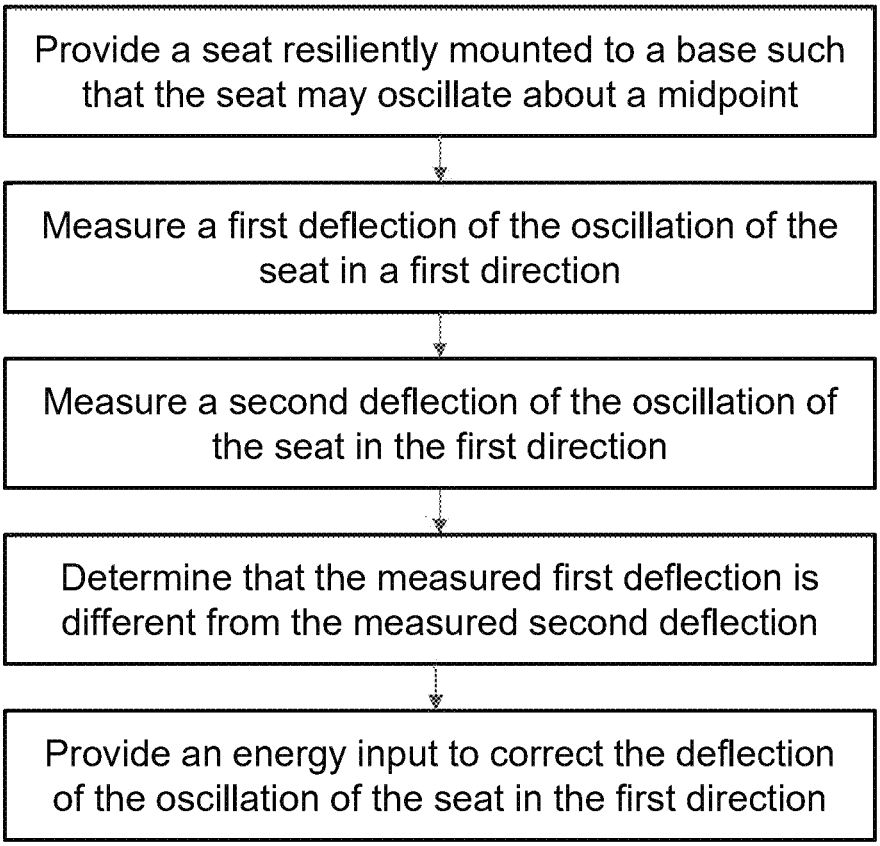
FIG. 10 shows a schematic of a method according to some embodiments.

As shown in FIG. 10, there are provided in some embodiments methods of controlling a baby bouncer. The method comprises in a first step, providing a seat resiliently mounted to a base such that the seat may oscillate about a midpoint. The method also comprises in a second step, measuring a first deflection of the oscillation of the seat in a first direction. Measurement of the first deflection in the first direction may include measuring the whole amplitude of the oscillation (i.e. from one end of the oscillation to the other end of the oscillation). Alternatively, measurement of the first deflection in the first direction may include measuring part of the oscillation. For example, measuring the first deflection in the first direction may include measuring the amplitude of the oscillation from the midpoint of the oscillation to one end of the oscillation. The first deflection being measured may be the result of a manual input to bounce the baby bouncer. Measuring of the first deflection may be initiated by a button press or by detecting that the seat has begun to move. The method comprises, in a third step, measuring a second deflection of the oscillation of the seat in the first direction. Measurement of the second deflection in the first direction may include measuring the whole amplitude of the oscillation or measuring part of the oscillation, similarly to measurement of the first deflection in the first direction. The second deflection being measured may be the result of the actuator controlled oscillation of the seat. The first and the second measured deflection may be measured in the same bouncing session, or in different bouncing sessions. For example, the first deflection may be measured in a bouncing session before being recalled in the subsequent bouncing session at a later time. The first and second bouncing sessions may be separated by a time period of no bouncing motions being applied to the seat. The method comprises in a fourth step, determining that the measured first deflection is different from the measured second deflection. For example, the first deflection may be greater or lesser than the second deflection. Determination that the measured second deflection is different from the measured first deflection may be initiated by determining that the measured second deflection is less than the measured first deflection by an amount corresponding to the natural decay in oscillation of the seat. For example, the processor may determine that a user has ceased manually bouncing the baby bouncer since the drop in deflection corresponds to the expected natural decay of the baby bouncer. In a fifth step, an energy input is provided to correct the deflection of the oscillation of the seat in the first direction. Correcting the deflection of the oscillation of the seat in the first direction may include adding or removing energy to the oscillating seat such that further oscillations will result in the measured deflections matching the first deflection.

The second deflection may be a measurement of a single oscillation or it may be a moving average of a predetermined number of the previous oscillations. For example, the measured second deflection may be equal to half the sum of the last two oscillations. The measured second deflection may be equal to a fifth of the sum of the last five oscillations. The moving average may be determined by any conventional means, for example calculating an average of the last few oscillations or by a weighted average of the last single oscillation and the previous average oscillation.

The energy input may be implemented by means of providing an actuator connected between the base and the seat, and by controlling the actuator to impart a force on the seat. The actuator may be an electromagnetic actuator.

Figure 11:
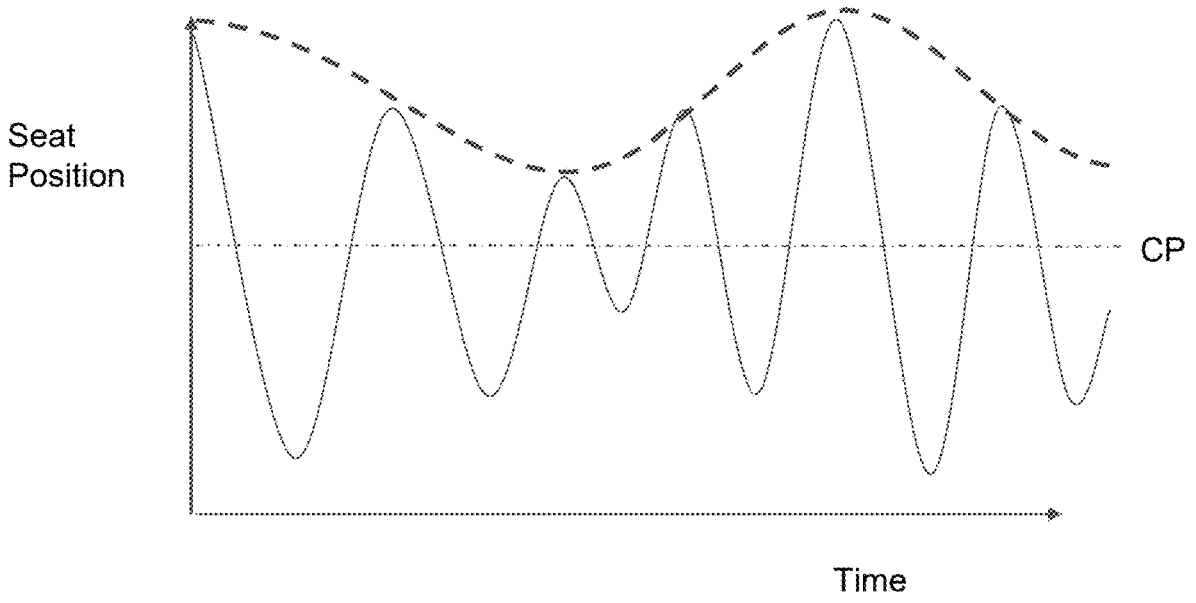
FIG. 11 shows a graph of varying oscillations of a baby bouncer according to an embodiment.

FIG. 11 shows the oscillation of the baby bouncer 100 according to a further embodiment. As shown in FIG. 11, the oscillations of the seat 102 may vary over time. FIG. 11 shows the amplitude of the oscillations gradually increasing and decreasing according to a sinusoidal profile shown by the broken line. However, the amplitude of the oscillations may alternatively vary over a longer time period. That is, the sinusoidal profile may be extended in the time axis such that for each amplitude, the seat 102 oscillates a plurality of times. Alternatively, the changing amplitude of oscillations may follow profiles other than a sinusoid, for example, the oscillation amplitudes may vary according to a sawtooth profile, an exponential repeating profile, or any other repeating profile. By varying the amplitude of the oscillations according to a profile, movement fatigue in the occupant can be avoided wherein the effect of prolonged consistent motions may be diminished. Additionally or alternatively, the baby bouncer 100 may be configured to alter the frequency of the oscillations according to a profile thereby reducing the effects of movement fatigue.

Figure 12:
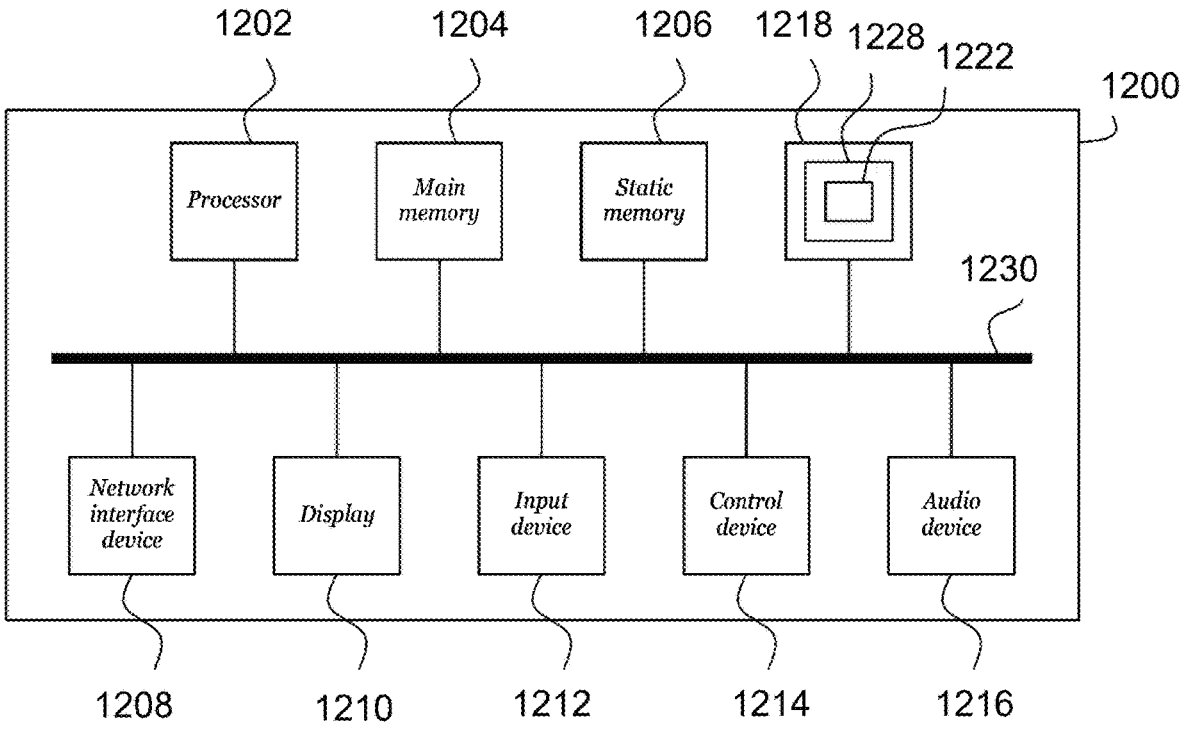
FIG. 12 shows a computing device for implementing the operations described herein.

With reference to FIG. 12, a processing system 1200 suitable for carrying out the methods described herein will now be described. FIG. 12 shows a block diagram of one implementation of a processing system 1200 in the form of a computing device within which a set of instructions for causing the computing device to perform any one or more of the methods described herein may be executed. In some implementations, the computing device may be connected (e.g., networked) to other machines in a Local Area Network (LAN), an intranet, an extranet, or the Internet. The computing device may operate in the capacity of a server or a client machine in a client-server network environment, or as a peer machine in a peer-to-peer (or distributed) network environment. The computing device may be a personal computer (PC), a tablet computer, a set-top box (STB), a Personal Digital Assistant (PDA), a cellular telephone, a web appliance, a server, a network router, switch or bridge, or any machine capable of executing a set of instructions (sequential or otherwise) that specify actions to be taken by that machine. Further, while only a single computing device is illustrated, the term 'computing device' shall also be taken to include any collection of machines (e.g., computers) that individually or jointly execute a set (or multiple sets) of instructions to perform any one or more of the methods described herein.

The example processing system 1200 includes a processor 1202, a main memory 1204 (e.g., read-only memory (ROM), flash memory, dynamic random-access memory (DRAM) such as synchronous DRAM (SDRAM) or Rambus DRAM (RDRAM), etc.), a static memory 1206 (e.g., flash memory, static random-access memory (SRAM), etc.), and a secondary memory (e.g., a data storage device 1218), which communicate with each other via a bus 1230.

Processor 1202 represents one or more general-purpose processors such as a microprocessor, central processing unit, or the like. More particularly, the processor 1202 may be a complex instruction set computing (CISC) microprocessor, reduced instruction set computing (RISC) microprocessor, very long instruction word (VLIW) microprocessor, processor implementing other instruction sets, or processors implementing a combination of instruction sets. Processor 1202 may also be one or more special-purpose processors such as an application specific integrated circuit (ASIC), a field programmable gate array (FPGA), a digital signal processor (DSP), network processor, or the like. Processor 1202 is configured to execute the processing logic (instructions 1222) for performing the operations and steps described herein.

The processing system 1200 may further include a network interface device 1208. The processing system 1200 also may include any of a video display unit 1210 (e.g., a liquid crystal display (LCD) or a cathode ray tube (CRT)), an alphanumeric input device 1212 (e.g., a keyboard or touchscreen), a cursor control device 1214 (e.g., a mouse or touchscreen), and an audio device 1216 (e.g., a speaker).

It will be apparent that some features of the processing system 1200 shown in FIG. 12 may be absent. For example, the processing system 1200 may have no need for display device 1210 (or any associated adapters). This may be the case, for example, for particular server-side computer apparatuses which are used only for their processing capabilities and do not need to display information to users. Similarly, user input device 1212 may not be required. In its simplest form, processing system 1200 comprises processor 1202 and main memory 1204.

The data storage device 1218 may include one or more machine-readable storage media (or more specifically one or more non-transitory computer-readable storage media) 1228 on which is stored one or more sets of instructions 1222 embodying any one or more of the methods or functions described herein. The instructions 1222 may also reside, completely or at least partially, within the main memory 1204 and/or within the processor 1202 during execution thereof by the processing system 1200, the main memory 1204 and the processor 1202 also constituting computer-readable storage media 1228.

The various methods described herein may be implemented by a computer program. The computer program may include computer code arranged to instruct a computer to perform the functions of one or more of the various methods described herein. The computer program and/or the code for performing such methods may be provided to an apparatus, such as a computer, on one or more computer-readable media or, more generally, a computer program product. The computer-readable media may be transitory or non-transitory. The one or more computer-readable media could be, for example, an electronic, magnetic, optical, electromagnetic, infrared, or semiconductor system, or a propagation medium for data transmission, for example for downloading the code over the Internet. Alternatively, the one or more computer-readable media could take the form of one or more physical computer-readable media such as semiconductor or solid-state memory, magnetic tape, a removable computer diskette, a random-access memory (RAM), a read-only memory (ROM), a rigid magnetic disc, or an optical disk, such as a CD-ROM, CD-R/W or DVD.

The computer program is executable by the processor 1202 to perform functions of the systems and methods described herein.

In an implementation, the modules, components, and other features described herein can be implemented as discrete components or integrated in the functionality of hardware components such as ASICS, FPGAs, DSPs, or similar devices.

A 'hardware component' is a tangible (e.g., non-transitory) physical component (e.g., a set of one or more processors) capable of performing certain operations and may be configured or arranged in a certain physical manner. A hardware component may include a general purpose processor, or dedicated circuitry or logic that is permanently configured to perform certain operations. A hardware component may be or include a special-purpose processor, such as a field programmable gate array (FPGA) or an ASIC. A hardware component may also include programmable logic or circuitry that is temporarily configured by software to perform certain operations.

Accordingly, the phrase 'hardware component' should be understood to encompass a tangible entity that may be physically constructed, permanently configured (e.g., hardwired), or temporarily configured (e.g., programmed) to operate in a certain manner or to perform certain operations described herein.

In addition, the modules and components can be implemented as firmware or functional circuitry within hardware devices. Further, the modules and components can be implemented in any combination of hardware devices and software components, or only in software (e.g., code stored or otherwise embodied in a machine-readable medium or in a transmission medium).

Figure 13:
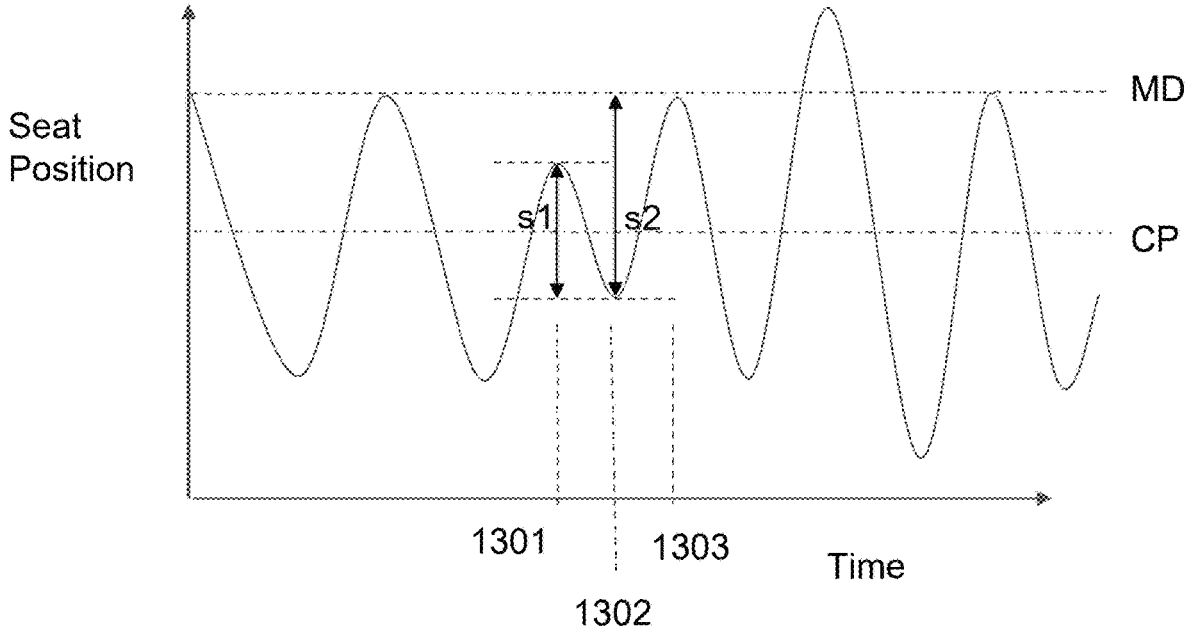
FIG. 13 shows a graph of the correction of the oscillation of a baby bouncer.
Figure 14:
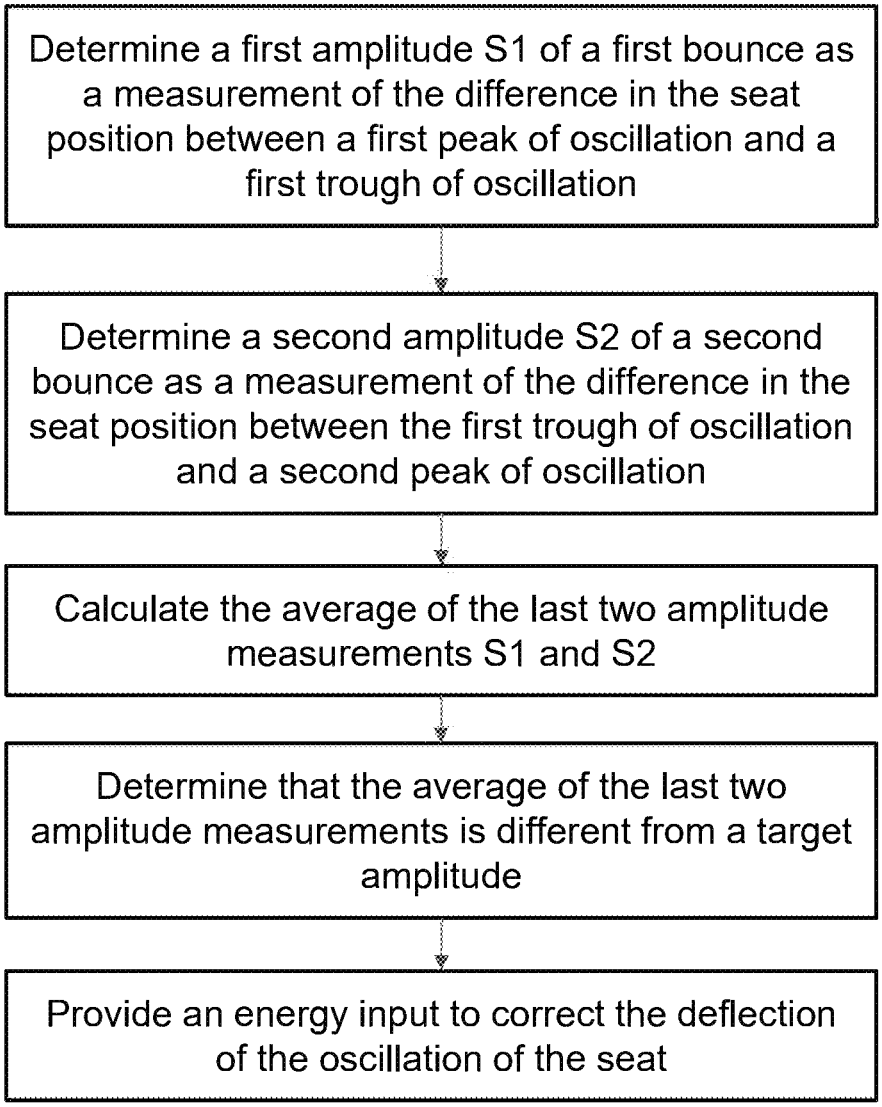
FIG. 14 shows a schematic of a method according to some embodiments.

FIGS. 13 and 14 show an implementation in which a rolling average may be used to determine the amplitude of the oscillation of a baby bouncer. In particular, a first amplitude S1 of a first bounce may be determined as the measurement of the difference in the seat position between a first peak 1301 of oscillation and a first trough 1302 of oscillation. A second amplitude S2 of a second bounce may be determined as the measurement of the difference in the seat position between the first trough 1302 of oscillation and a second peak 1303 of oscillation. The average value of S1 and S2 may be determined as:

$$(S1 + S2)/2$$

By calculating the average of the last two amplitude measurements and using the average to control the oscillation of the baby bouncer, a more consistent bounce response from the baby bouncer may be achieved. For example, a baby may move independently within the baby bouncer resulting in one or more spurious measurements of amplitude. By averaging a previous number of amplitude measurements, movement of the baby may be mitigated by only responding to changes in the amplitude which are consistent between subsequent peaks and troughs of the oscillation. Therefore, if a single spurious amplitude is measured, the effect of that spurious amplitude has a lesser effect on the control of the bouncing by the actuator. Whilst two previous amplitude measurements are shown in FIG. 13, it will be appreciated that three, four, five, or any suitable number of previous measurements of amplitude may be used to calculate an average amplitude according to:

$$(S1 + S2 + \ldots Sn)/n$$

Where n is the number of previous amplitudes to be used in the rolling average.

Where the rolling average, or the average of the last two amplitude measurements is different from a target amplitude, energy may be input to correct the deflection of the oscillation of the seat. That is, the seat may selectively be driven or not driven in order to impart a greater or lesser oscillation to correct the oscillation of the seat to approach the target oscillation.

The following is a non-exhaustive list of aspects of the present disclosure:

Aspect 1. A baby bouncer comprising a base;

a seat configured to receive a baby;

a joint connecting the seat with the base and configured to support the seat above the base, and wherein the joint is configured to permit reciprocating motion of the seat relative to the base; and an actuator connected between the base and the seat, and configured to impart a driving force on the seat.

Aspect 2. The baby bouncer of aspect 1, wherein the actuator is an electromagnetic actuator and wherein the driving force is a magnetic force.

Aspect 3. The baby bouncer of aspect 1 or aspect 2, wherein the joint comprises a resilient member configured to support the seat at a central position above the base and return the seat towards the central position after the seat has been deflected.

Aspect 4. The baby bouncer of aspect 1 or aspect 2, wherein the joint comprises a hinge or an axle configured to support the seat at a central position above the base and allow rotation of the seat relative to the base.

Aspect 5. The baby bouncer of aspect 4, further comprising a resilient member connected to the seat and to the base and configured to return the seat towards the central position after the seat has been deflected, and optionally wherein the baby bouncer comprises an adjustment member connected to the resilient member and configured to adjust a pre-load applied to the resilient member.

Aspect 6. The baby bouncer of aspect 5, wherein the resilient member comprises an extension spring, optionally wherein the extension spring is a coil spring.

Aspect 7. The baby bouncer of aspect 6, wherein the joint is located at a first height and first lateral position relative to the base, the extension spring is connected to the seat at a first connection point, the extension spring is connected to the base at a second connection point, wherein the second connection point is located at a second height and a second lateral position relative to the base, and wherein the first connection point lies substantially on a straight line between the joint and the second connection point.

Aspect 8. The baby bouncer of any of aspects 5 to 7, wherein deflection of the seat causes an extension and a rotation of the resilient member.

Aspect 9. The baby bouncer of aspect 8, wherein rotation of the resilient member is configured to change the effective spring rate of the restoring force to return the seat towards the central position.

Aspect 10. The baby bouncer of any of aspects 4 to 9, wherein the seat comprises a swingarm and a baby receptacle, and wherein the swingarm extends substantially from the baby receptacle and past the hinge or axle.

Aspect 11. The baby bouncer of any of aspects 4 to 10, wherein the hinge or axle is supported by a post extending upwardly from the base.

Aspect 12. The baby bouncer of aspect 2, wherein the electromagnetic actuator comprises an electromagnetic coil fixed to the base and the seat comprises a magnetic material in proximity to the electromagnetic coil, optionally wherein the magnetic material is a ferromagnetic material or a permanent magnet.

Aspect 13. The baby bouncer of aspect 2, wherein the electromagnetic actuator comprises an electromagnetic coil fixed to the seat and the base comprises a magnetic material in proximity to the electromagnetic coil, optionally wherein the magnetic material is a ferromagnetic material or a permanent magnet.

Aspect 14. The baby bouncer of aspect 12 or aspect 13, further comprising an electrical driver configured to drive the electromagnetic coil with an electric current and optionally wherein the electrical driver is configured to provide an electric current to attract the magnetic material, or wherein the electrical driver is configured to provide an electric current to repel the magnetic material.

Aspect 15. The baby bouncer of any preceding aspect, further comprising a sensor configured to detect one or more of the deflection of the seat relative to the base, the velocity of the seat relative to the base, and the acceleration of the seat, and optionally wherein the sensor comprises an optical encoder, electromagnetic encoder, a Micro Electromechanical Sensor (MEMS) device, a gyroscope, an accelerometer, or the electromagnetic coil.

Aspect 16. The baby bouncer of aspect 15, wherein the sensor is connected to a processor, and wherein the processor is configured to derive the velocity of the seat relative to the base from multiple measurements of the deflection of the seat relative to the base, or wherein the processor is configured to derive the velocity of the seat relative to the base by numerical integration of the acceleration of the seat.

Aspect 17. The baby bouncer of aspect 15 or aspect 16, wherein when the sensor or processor detects a velocity of the seat in a first direction relative to the base the electromagnetic actuator is configured to drive the seat in the first direction.

Aspect 18. The baby bouncer of aspect 17, wherein when the sensor or processor detects a velocity of the seat in a second direction opposite to the first direction, the electromagnetic actuator is configured to not drive the seat in the first direction or the second direction.

Aspect 19. The baby bouncer of any of aspects 15 to 18, wherein the sensor or processor is configured to detect a maximum displacement of the seat relative to the base without the electromagnetic actuator driving the seat.

Aspect 20. The baby bouncer of aspect 19, wherein the sensor is configured to detect current displacement of the seat relative to the base whilst the electromagnetic actuator is driving the seat.

Aspect 21. The baby bouncer of aspect 20, wherein when the current displacement of the seat relative to the base is less than the maximum displacement of the seat relative to the base, the electromagnetic actuator is configured to provide a greater drive force to deflect the seat, and when the current displacement of the seat relative to the base is greater than the maximum displacement of the seat relative to the base, the electromagnetic actuator is configured to provide a lesser drive force to deflect the seat.

Aspect 22. The baby bouncer of any of aspects 19 to 21, wherein the sensor or processor is configured to detect a maximum displacement of the seat relative to the base without the electromagnetic actuator driving the seat in response to a trigger, and optionally wherein the trigger is caused by a button on the baby bouncer, or by a connected device, or by deflection of the seat relative to the base exceeding a predetermined threshold.

Aspect 23. The baby bouncer of any of aspects 19 to 22, wherein the maximum displacement of the seat relative to the base is retrieved from electronic memory or from a server in communication with the baby bouncer.

Aspect 24. The baby bouncer of any of aspects 19 to 23, wherein the maximum displacement of the seat relative to the base is user adjustable.

Aspect 25. The baby bouncer of any of aspects 15 to 24, wherein the sensor or processor is configured to detect when the velocity of the seat relative to the base drops below a predetermined threshold for more than a predetermined time period, and, in response to detecting when the velocity of the seat drops below the predetermined threshold for more than the predetermined time period, the electromagnetic actuator is configured to cease driving the seat relative to the base, and optionally wherein in response to detecting when the velocity of the seat drops below the predetermined threshold for more than the predetermined time period the electromagnetic actuator is configured to apply a braking force to the seat relative to the base.

Aspect 26. The baby bouncer of any preceding aspect, wherein the electromagnetic actuator comprises a load cell configured to detect the force applied by the electromagnetic actuator.

Aspect 27. The baby bouncer of aspect 26, wherein the electromagnetic actuator is configured to cease driving the seat relative to the base when the force detected by the load cell exceeds a predefined threshold.

Aspect 28. The baby bouncer of any preceding aspect, wherein the actuator is releasably connected between the base and the seat, and optionally wherein the actuator is configured to be disconnected from the base and disconnected from the seat.

Aspect 29. The baby bouncer of any preceding aspect, wherein the joint is configured such that the reciprocating motion of the seat extends in a substantially vertical direction with respect to the base.

Aspect 30. The baby bouncer of any preceding aspect, wherein the joint is configured such that the reciprocating motion of the seat follows a path, and wherein the path is linear or circular, or elliptical, or follows a figure of 8.

Aspect 31. A method of controlling a baby bouncer, comprising providing a seat resiliently mounted to a base such that the seat may oscillate about a midpoint;

measuring a first deflection of the oscillation of the seat in a first direction;

measuring a second deflection of the oscillation of the seat in the first direction;

determining that the measured first deflection is different from the measured second deflection; and providing an energy input to correct the deflection of the oscillation of the seat in the first direction.

Aspect 32. The method of aspect 31, wherein the baby bouncer further comprises an actuator connected between the base and the seat and the step of providing an energy input to correct the deflection of the oscillation of the seat in the first direction comprises controlling the actuator to impart a force on the seat in the first direction.

Aspect 33. The method of aspect 31 or 32, wherein the first deflection of the oscillation of the seat in the first direction is a user-controlled manual deflection of the seat.

Aspect 34. The method of any of aspects 31 to 33, wherein the second deflection of the oscillation of the seat in the first direction is an actuator-controlled deflection of the seat.

Aspect 35. The method of any of aspects 31 to 34, wherein the actuator is an electromagnetic actuator.

Aspect 36. The method of any of aspects 31 to 35, wherein the measuring of the first deflection of the oscillation of the seat in the first direction is initiated by a button in communication with the baby bouncer, a user device in communication with the baby bouncer, or automatically upon detection of manual movement of the seat in the first direction beyond a predetermined threshold.

Aspect 37. The method of any of aspects 31 to 35 wherein the measuring of the first deflection of the oscillation of the seat in the first direction is performed in a first bouncing session, and the measuring of the second deflection of the oscillation of the seat in the first direction is performed in a second bouncing session, and optionally wherein the first bouncing session and the second bouncing session are separated by a time period of no oscillation of the seat.

Aspect 38. A method of controlling a baby bouncer comprising:

providing a seat resiliently mounted to a base such that the seat may oscillate about a midpoint;

detecting, using a sensor, a deflection of the seat in a first direction;

detecting, using the sensor, a deflection of the seat in a second direction opposite to the first direction;

imparting a driving force to the seat in the first direction when the deflection of the seat in the first direction is detected; and not imparting a driving force to the seat when the deflection of the seat in the second direction is detected.

Aspect 39. The method of aspect 38, wherein the driving force is imparted to the seat by means of an actuator, optionally an electromagnetic actuator.

Aspect 40. The method of aspect 38 or 39, wherein the seat is mounted to the base by a bearing and the resilience is provided by a spring.

Aspect 41. The method of aspect 40 when dependent on aspect 39, wherein the spring is configured to have a spring rate such that the maximum force provided by the electromagnetic actuator is exceeded by the maximum force provided by the spring at a maximum deflection of the seat.

Aspect 42. The method of any of aspects 38 to 41, wherein the sensor comprises one or more of an optical encoder, an inductive sensor, an accelerometer, or a position sensor.

Aspect 43. An infant soothing device comprising a stand, an infant receiving portion;

wherein the infant receiving portion is rotatably mounted on the stand;

a biasing means connected to the infant receiving portion and configured to cause a rotation of the infant receiving portion relative to the stand.

Aspect 44. The infant soothing device of aspect 43 wherein the biasing means is an active biasing means, and optionally wherein the active biasing means is configured to convert an electrical input into rotation of the infant receiving portion.

Aspect 45. The infant soothing device of any of aspects 43 to 44, wherein the active biasing means comprises one or more of an electrical coil, a coil spring, a leaf spring, a pneumatic chamber, and a hydraulic chamber.

Aspect 46. The infant soothing device of any of aspects 43 to 45, wherein the infant receiving portion is rotatably mounted on the stand such that the infant receiving portion extends vertically away from the stand, or such that the infant receiving portion extends horizontally away from the stand, and optionally wherein the infant receiving portion is configured to oscillate about a midpoint.

Aspect 47. The infant soothing device of aspect 46 wherein the oscillation about a midpoint of the infant receiving portion is configured to extend in a substantially vertical direction, or in a substantially horizontal direction.

The invention claimed is:

1. A baby bouncer, comprising:

a base;

a seat configured to receive a baby;

a joint connecting the seat with the base and configured to support the seat above the base, wherein the joint is configured to permit reciprocating motion of the seat relative to the base; and an electromagnetic actuator comprising an electromagnetic coil fixed to one of the base or the seat, and configured to impart a magnetic driving force on the seat, wherein the other one of the base or the seat comprises a magnetic material in proximity to the electromagnetic coil.

2. The baby bouncer of claim 1, wherein the joint comprises a resilient member configured to support the seat at a central position above the base and return the seat towards the central position after the seat has been deflected.

3. The baby bouncer of claim 1, wherein the joint comprises a hinge or an axle configured to support the seat at a central position above the base and allow rotation of the seat relative to the base.

4. The baby bouncer of claim 3, wherein the hinge or axle is supported by a post extending upwardly from the base.

5. The baby bouncer of claim 3, wherein the hinge or the axle is disposed horizontally with respect to the base.

6. The baby bouncer of claim 3, further comprising a resilient member connected to the seat and to the base and configured to return the seat towards the central position after the seat has been deflected.

7. The baby bouncer of claim 6, further comprising an adjustment member connected to the resilient member and configured to adjust a pre-load applied to the resilient member.

8. The baby bouncer of claim 6, wherein the resilient member comprises an extension spring.

9. The baby bouncer of claim 8, wherein the joint is located at a first height and first lateral position relative to the base, the extension spring is connected to the seat at a first connection point, the extension spring is connected to the base at a second connection point, wherein the second connection point is located at a second height and a second lateral position relative to the base, and wherein the first connection point lies substantially on a straight line between the joint and the second connection point.

10. The baby bouncer of claim 6, wherein deflection of the seat causes an extension and a rotation of the resilient member.

11. The baby bouncer of claim 10, wherein rotation of the resilient member is configured to change the effective spring rate of the restoring force to return the seat towards the central position.

12. The baby bouncer of claim 3, wherein the seat comprises a swingarm and a baby receptacle, and wherein the swingarm extends substantially from the baby receptacle and past the hinge or axle.

13. The baby bouncer of claim 1, further comprising a sensor configured to detect one or more of the deflection of the seat relative to the base, the velocity of the seat relative to the base, and the acceleration of the seat.

14. The baby bouncer of claim 13, wherein when the sensor detects a velocity of the seat in a first direction relative to the base the electromagnetic actuator is configured to drive the seat in the first direction.

15. The baby bouncer of claim 14, wherein when the sensor detects a velocity of the seat in a second direction opposite to the first direction relative to the base, the electromagnetic actuator is configured to not drive the seat in the first direction or the second direction.

16. The baby bouncer of claim 13, wherein the sensor is configured to detect a maximum displacement of the seat relative to the base without the electromagnetic actuator driving the seat.

17. The baby bouncer of claim 13, wherein the sensor comprises an optical encoder, electromagnetic encoder, a Micro Electromechanical Sensor (MEMS) device, a gyroscope, an accelerometer, or an electromagnetic coil.

18. A baby bouncer, comprising:

a base;

a seat configured to receive a baby;

a joint comprising a hinge or an axle, connecting the seat with the base, the joint configured to:

support the seat at a central position above the base, allow reciprocating motion of the seat relative to the base, and allow rotation of the seat relative to the base;

an actuator connected between the base and the seat, and configured to impart a driving force on the seat; and an extension spring connected to the seat at a first connection point and to the base at a second connection point, and configured to return the seat towards the central position after the seat has been deflected, wherein the joint is located at a first height and a first lateral position relative to the base, and the second connection point is located at a second height and a second lateral position relative to the base, and wherein the first connection point lies substantially on a straight line between the joint and the second connection point.

19. A baby bouncer, comprising:

a base;

a seat configured to receive a baby;

a joint connecting the seat with the base and configured to:

support the seat above the base, and allow reciprocating motion of the seat relative to the base;

an actuator connected between the base and the seat, and configured to impart a driving force on the seat; and a sensor configured to detect a velocity of the seat relative to the base, wherein when the sensor detects a velocity of the seat in a first direction relative to the base, the actuator is configured to drive the seat in the first direction.

20. The baby bouncer of claim 19, wherein when the sensor detects a velocity of the seat in a second direction opposite to the first direction relative to the base, the actuator is configured to not drive the seat in the first direction or the second direction.

21. A method of controlling a baby bouncer, comprising:

providing a seat resiliently mounted to a base such that the seat may oscillate about a midpoint;

measuring a first deflection of the oscillation of the seat in a first direction;

measuring a second deflection of the oscillation of the seat in the first direction;

determining that the measured first deflection is different from the measured second deflection; and providing an energy input to correct the deflection of the oscillation of the seat in the first direction.

22. The method of claim 21, wherein the baby bouncer further comprises an actuator connected between the base and the seat and the step of providing an energy input to correct the deflection of the oscillation of the seat in the first direction comprises controlling the actuator to impart a force on the seat in the first direction.

23. The method of claim 21, wherein the measuring of the first deflection of the oscillation of the seat in the first direction is initiated by a button in communication with the baby bouncer, a user device in communication with the baby bouncer, or automatically upon detection of manual movement of the seat in the first direction beyond a predetermined threshold.

24. A method of controlling a baby bouncer, comprising:

providing a seat resiliently mounted to a base such that the seat may oscillate about a midpoint;

detecting, using a sensor, a deflection of the seat in a first direction;

detecting, using the sensor, a deflection of the seat in a second direction opposite to the first direction;

imparting a driving force to the seat in the first direction when the deflection of the seat in the first direction is detected; and not imparting a driving force to the seat when the deflection of the seat in the second direction is detected.

* * * * *